US012612823B2

(12) United States Patent
Kabiraj

(10) Patent No.: US 12,612,823 B2
(45) Date of Patent: Apr. 28, 2026

(54) DOWN-THE-HOLE HAMMER WITH ADJUSTABLE AIR CONSUMPTION VALVE

(71) Applicant: Caterpillar Inc., Peoria, IL (US)

(72) Inventor: Koushik Kabiraj, Jharkhand (IN)

(73) Assignee: Caterpillar Inc., Peoria, IL (US)

( * ) Notice: Subject to any disclaimer, the term of this patent is extended or adjusted under 35 U.S.C. 154(b) by 127 days.

(21) Appl. No.: 18/318,628

(22) Filed: May 16, 2023

(65) Prior Publication Data

US 2024/0384598 A1 Nov. 21, 2024

(51) Int. Cl.
*E21B 4/14* (2006.01)

(52) U.S. Cl.
CPC ..... *E21B 4/14* (2013.01)

(58) Field of Classification Search
CPC ..... E21B 34/14; E21B 4/14; E21B 1/30
See application file for complete search history.

(56) References Cited

U.S. PATENT DOCUMENTS

| | | | | |
|---|---|---|---|---|
| 3,826,316 | A | 7/1974 | Bassinger | |
| 4,221,157 | A | 9/1980 | Schmidt | |
| 4,923,018 | A * | 5/1990 | Meek | E21B 4/14 173/135 |
| 6,431,294 | B1 | 8/2002 | Eddison et al. | |
| 6,454,026 | B1 | 9/2002 | Sanvik | |
| 6,799,641 | B1 | 10/2004 | Lyon et al. | |
| 7,757,779 | B2 | 7/2010 | Jacobsson et al. | |
| 8,141,663 | B2 | 3/2012 | Lyon et al. | |
| 8,215,419 | B2 | 7/2012 | Plunkett et al. | |
| 10,323,457 | B2 | 6/2019 | Boswell | |
| 11,174,679 | B2 | 11/2021 | Bruandet | |
| 2016/0199969 | A1 | 7/2016 | Moore | |
| 2017/0101852 | A1 * | 4/2017 | Hawkins, III | E21B 21/10 |
| 2018/0051560 | A1 * | 2/2018 | Smarandache | E21B 34/08 |

FOREIGN PATENT DOCUMENTS

| | | |
|---|---|---|
| EP | 0580056 | 1/1994 |
| FR | 2305580 A1 | 10/1976 |
| WO | 9854433 | 12/1998 |

OTHER PUBLICATIONS

Written Opinion and International Search Report for Int'l. Patent Appln. No. PCT/US2024/025089, mailed Jul. 10, 2024 (13 pgs).

* cited by examiner

*Primary Examiner* — Dany E Akakpo

(57) ABSTRACT

A down-the-hole hammer includes a barrel having a longitudinal axis and defining a proximal chamber and a distal chamber, a piston slidable within the barrel between the proximal chamber and the distal chamber, a control tube having a slot, a check valve member rotationally fixed to the control tube, and an air distributor having a plurality of sets of ports. Each set of ports includes a proximal port and a distal port longitudinally spaced apart from one another. The control tube is indexable between a plurality of rotational positions by rotating the check calve member to adjust which of the sets of ports of the air distributor is aligned with the slot of the control tube.

20 Claims, 18 Drawing Sheets

DOWN-THE-HOLE HAMMER WITH ADJUSTABLE AIR CONSUMPTION VALVE

TECHNICAL FIELD

The present disclosure relates generally to drilling hammers, and more particularly, to a down-the-hole hammer having an adjustable air consumption valve.

BACKGROUND

Surface drilling is a necessary operation in many industries including mining, oil and gas extraction, construction, geothermal drilling, and many others. Various types of equipment, referred to as drilling hammers, may be used to generate impact and percussive forces to break ground and advance a drilling bit through rock and soil. One class of drilling hammers, known as down-the-hole hammers, are mounted to the bottom end of a drill string and include (or are directly adjacent to) the drilling bit. Down-the-hole hammers typically produce a hammering action by pneumatic or hydraulic action, with the motive fluid (e.g. air, water, or drilling mud) being supplied down the drill string to the hammer.

U.S. Pat. No. 6,454,026 issued on Sep. 24, 2002 ("the '026 patent"), describes a down-the-hole percussive hammer including a cylindrical casing adapted to carry a drill bit, and a piston mounted in the casing for reciprocal movement to repeatedly strike the drill bit. A proximal subassembly is mounted at a proximal portion of the casing, and includes a distal face extending toward the piston. A feed tube is mounted to the proximal subassembly and extends distally along a center axis of the casing and defines an air-conducting passage. The piston includes an axial through-hole which slidably receives the feed tube. The distal face and the feed tube together define a recess opening toward the piston. A removable volume-changer is insertable into the recess to vary a volume of a space in which the piston slides, and thus control a pressure at which the piston operates. In order to access the volume-changer, significant portions of the hammer must be disassembled, so setting the operation pressure of the hammer is time consuming and labor intensive.

The down-the-hole hammer of the present disclosure may solve one or more of the problems set forth above and/or other problems in the art. The scope of the current disclosure, however, is defined by the attached claims, and not by the ability to solve any specific problem.

SUMMARY

In one aspect, the present disclosure relates to a down-the-hole hammer including a barrel having a longitudinal axis and defining a proximal chamber and a distal chamber, a piston slidable within the barrel between the proximal chamber and the distal chamber, a control tube having a slot, a check valve member rotationally fixed to the control tube, and an air distributor having a plurality of sets of ports. Each set of ports includes a proximal port and a distal port longitudinally spaced apart from one another. The control tube is indexable between a plurality of rotational positions by rotating the check calve member to adjust which of the sets of ports of the air distributor is aligned with the slot of the control tube.

In another aspect, the present disclosure relates to a method for adjusting an air consumption valve of a down-the-hole hammer including a control tube and an air distributor. The control tube includes a slot. The air distributor includes a first set of ports and a second set of ports, each set of ports including a proximal port and a distal port longitudinally spaced apart from one another. The first set of ports corresponds to a first target air flow rate and target air pressure, and the second set of ports corresponds to a second target air flow rate and target air pressure. The method includes rotating the control tube relative to the air distributor so that a slot of the control tube aligns with one of the first set of ports and the second set of ports of the air distributor.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Figure 1:
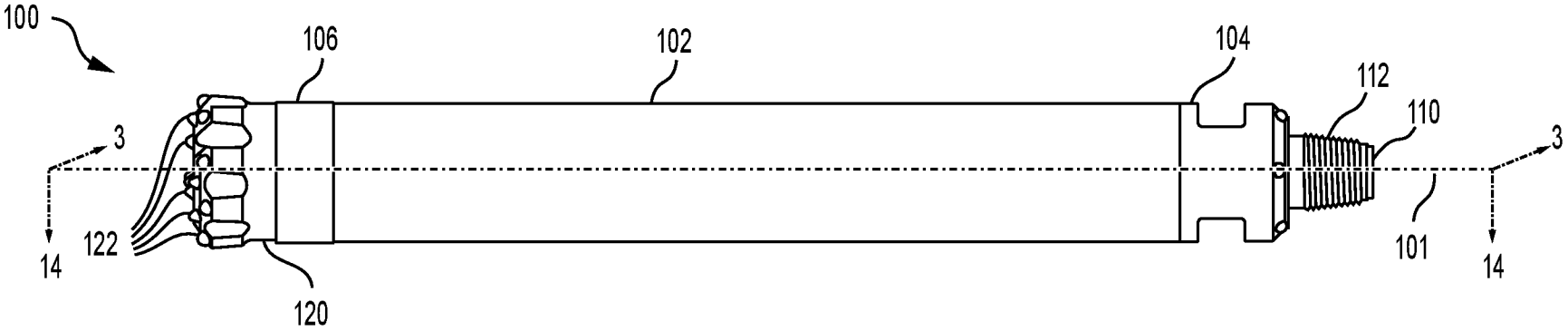
FIG. 1 is a side view of a down-the-hole hammer, according to aspects of the present disclosure.

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value. Throughout the accompanying drawings, like reference numerals refer to like components.

Figure 2:
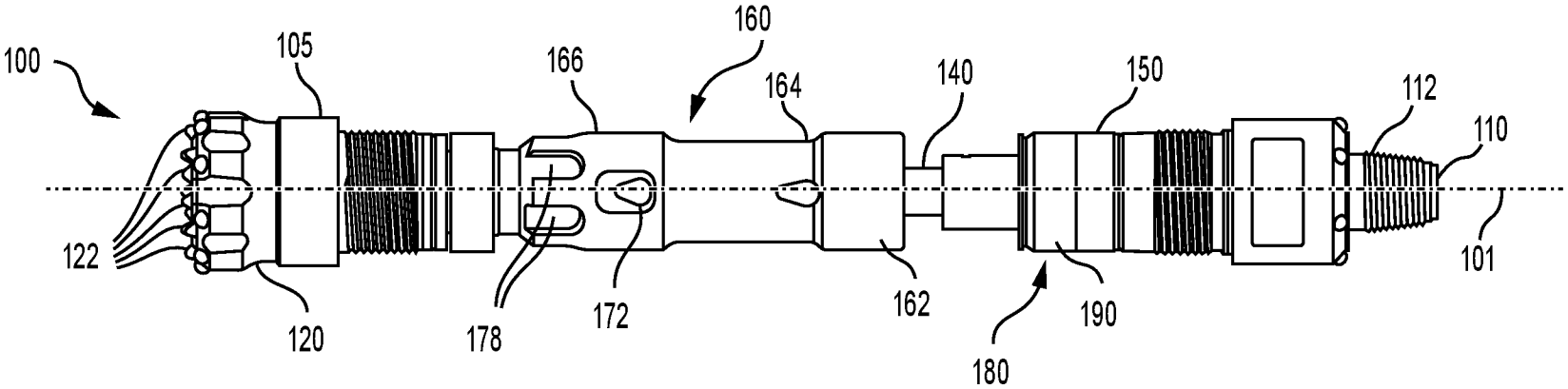
FIG. 2 is a side view of the down-the-hole hammer of FIG. 1, with the barrel thereof removed to show internal components.
Figure 3:
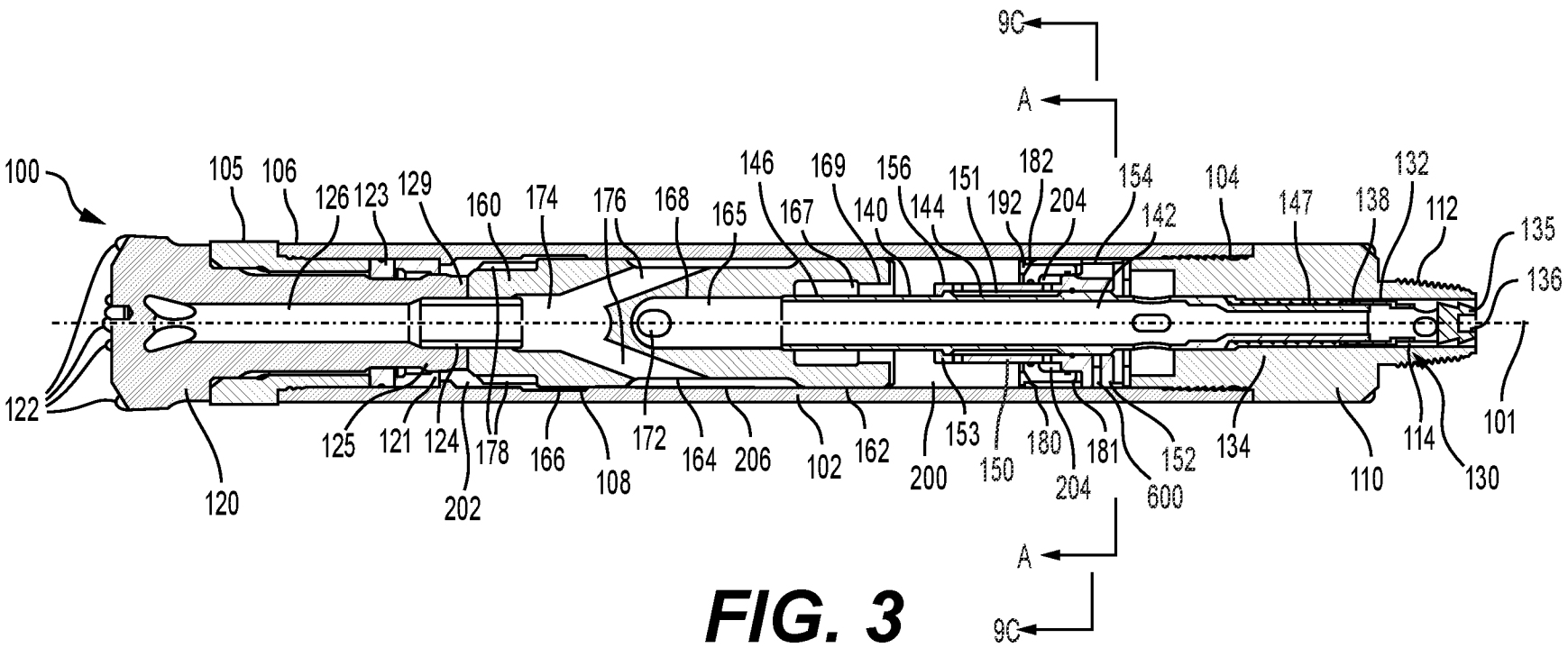
FIG. 3 is a cross-sectional side view of the down-the-hole hammer of FIG. 1, viewed along section line 3-3 of FIG. 1.

Referring now to FIGS. 1, 2 and 3, a down-the-hole drilling hammer (hereinafter "hammer 100") in accordance with aspects of the present disclosure includes a barrel 102 housing various other components of hammer 100. Barrel 102 defines a longitudinal axis 101 extending from a top (or proximal) end 104 to a bottom (or distal) end 106 of barrel 102. Barrel 102 is generally cylindrical and includes an inner diameter that defines a bore 103 (see FIG. 3) extending from proximal end 104 to distal end 106. The bore of barrel 102 includes an annular recess 108 (see FIG. 3) that provides a flow path to selectively allow airflow between various regions of barrel 102 during operation of hammer 100, as will be described herein.

An adapter 110 is connected to proximal end 104 of barrel 102, for example by a threaded connection. Adapter 110 includes an interface 112, for example a threaded fitting as illustrated, for connection to a drill string (not shown). Adapter 110 further includes a bore 114 that receives pressurized air supplied from the drill string (e.g., via a compressor).

Hammer bit (hereinafter "bit 120") is disposed in distal end 106 of barrel 102 in a manner that allows limited sliding of bit 120 along longitudinal axis 101. In particular, a drive chuck 105 is threaded into distal end 106 of barrel 102. Drive chuck 105 includes an internal anti-rotation feature (e.g., splines) that interact with complementary features on bit 120 to allow bit 120 to slide along axis 101 but not rotate relative to barrel 102. When threaded into barrel 102, drive chuck 105 retains a stop ring 123 (which may be formed of two half rings) within barrel 102 adjacent a guide sleeve 121. Stop ring 123 limits distal travel of bit 120 by engaging a protrusion 125 of bit 120 (see FIG. 3) when bit 120 is at a distal-most position, thereby preventing bit 120 from sliding out of barrel 102. Bit 120 includes a distal end having one or more digging features 122 (e.g., tips, teeth, etc.) for cutting/breaking ground and/or rock. Bit 120 is connected or integrally formed with a foot valve 124. A bore 126 extends through foot valve 124 and at least partially through bit 120. An exhaust port 128 extends from bore 126 and opens to an external surface (e.g., the distal end) of bit 120. Bit 120 includes a strike face 129 that is struck by a piston 160 of hammer 100 to cause bit 120 to create an impact against the ground, a rock face, etc., as will be described in greater detail herein. In some aspects, hammer 100 may lack foot valve 124, with the design of bit 120 and/or piston 160 being modified to perform the same functionality as foot valve 124.

A check valve 130 is disposed within barrel 102 and/or adapter 110, and is configured to open in response to air pressure supplied to bore 114 of adapter 110. Check valve 130 is configured to close when pressure with hammer 100 exceeds pressure in drill string (not shown). As such, check valve 130 may close at times during operation of hammer 100, depending on the relative air pressure between hammer 100 and the drill string. Check valve 130 may include a valve member 132 biased against a shoulder or other surface of bore 114 by a spring 134. Spring 134 may be configured to compress when a predetermined air pressure acts against valve member 132, allowing valve member 132 to slide distally within bore 114 and air to pass by valve member 132 toward distal end 106 of barrel 102.

Figure 5:
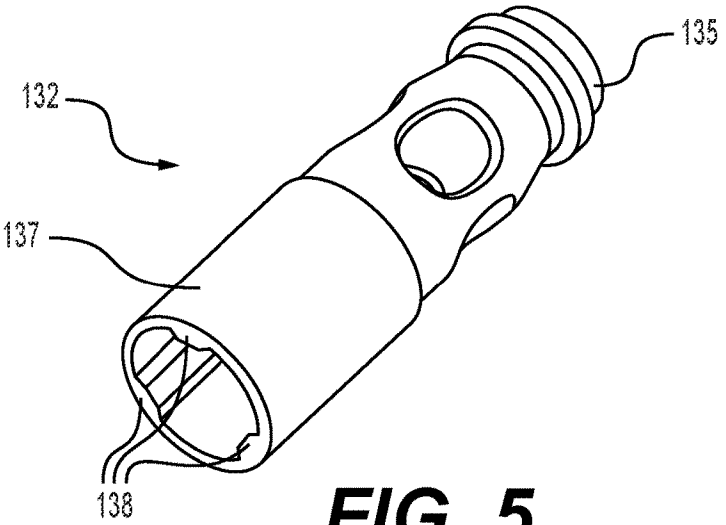
FIG. 5 is a rear perspective view of the down-the-hole hammer of FIG. 1.
Figure 4:
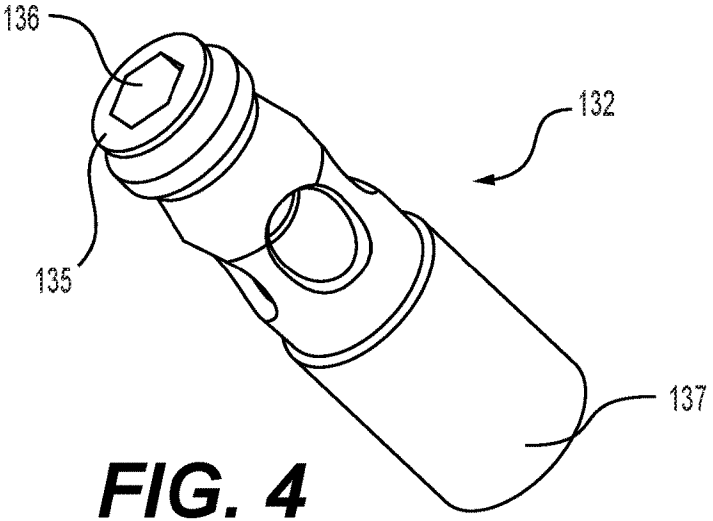
FIG. 4 is a front perspective view of a check valve of the down-the-hole hammer of FIG. 1.
Figure 6:
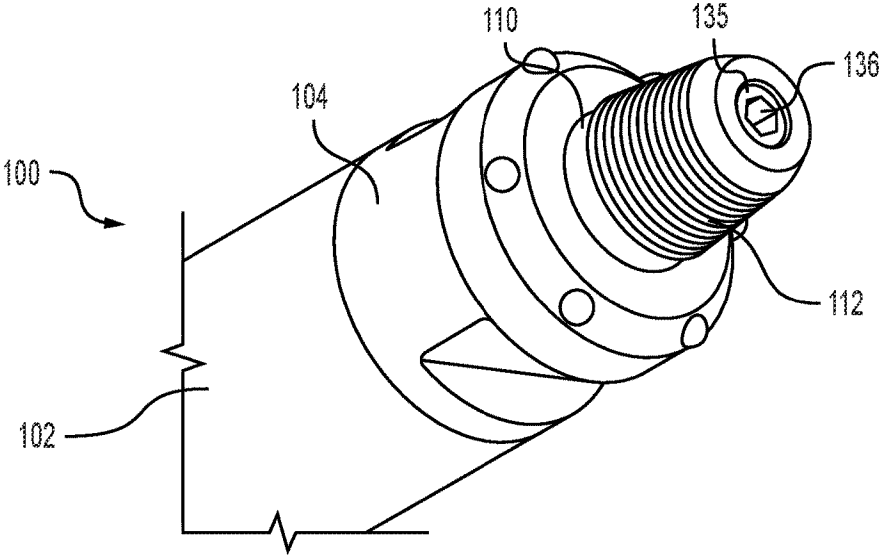
FIG. 6 is a perspective view of a proximal end of the down-the-hole hammer of FIG. 1.
Figure 7A:
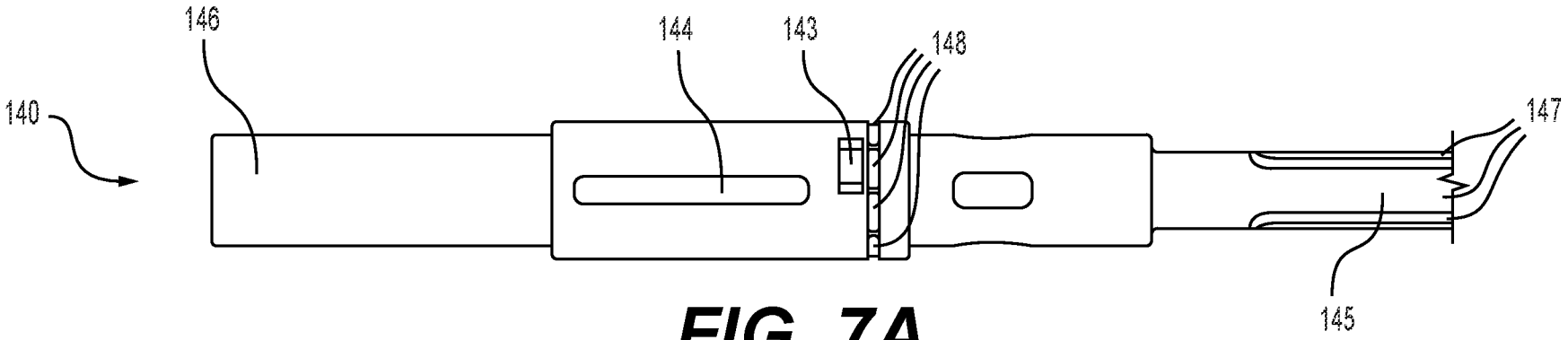
FIG. 7A is a side view of a control tube of the down-the-hole hammer of FIG. 1.
Figure 7B:
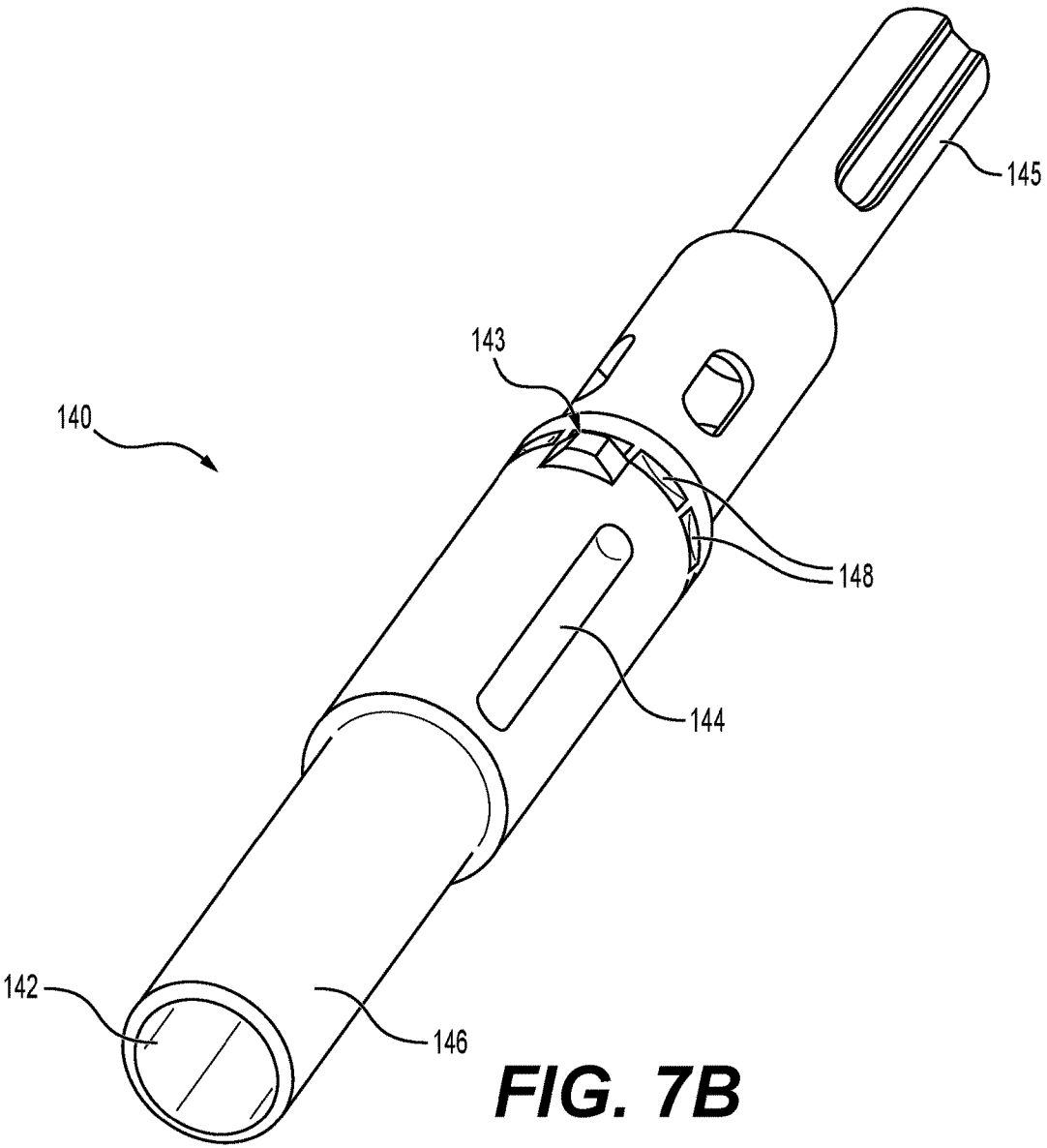
FIG. 7B is a perspective view of the control tube of FIG. 7A.

Referring now to FIGS. 4-6, a proximal end 135 of valve member 132 includes a tool interface 136 configured to receive a wrench or other tool to facilitate rotation of valve member 132. In the illustrated aspect, tool interface 136 is a hex socket configured to receive a hex key, though other forms of tool interface 136 may be appreciated as being within the scope of the present disclosure. Tool interface 136 is accessible via adapter 110, as shown in FIG. 6, without removing adapter 110 from barrel 102. To access tooling interface 136, only drill string (not shown) needs to be disconnected from adapter 110.

With continued reference to FIGS. 3 and 5, a distal end 137 of valve member 132 includes one or more splines 138 extending in a longitudinal direction and radially inward towards longitudinal axis 101. Spline(s) are configured to engage complementary grooves 147 on a control tube 140 of hammer 100. In some aspects, one or more splines 138 include three splines. In the illustrated aspect, valve member 130 includes spline(s) 138 while control tube 140 includes complementary grooves 147, but in other embodiments valve member 130 may include grooves with control tube 140 including complementary splines.

Referring now to FIGS. 2, 3, 7A, 7B, and 8 control tube 140 having a hollow bore 142 extending parallel to longitudinal axis 101 is disposed within barrel 102. Control tube 140 may extend at least partially into bore 114 of adapter 110. Spring 134 of check valve 130 may be seated in a shoulder of bore 142 of control tube 140. Bore 142 is in fluid communication with bore 114 of adapter 110 when check valve 130 is opened by air pressure. That is, air flowing past check valve 130 may flow into bore 142 of control tube 140. Control tube 140 includes a slot 144 extending partially along an outer surface of control tube 140. Slot 144 provides a path for air flow to various components and chambers of hammer 100, in particular to actuate a flow control valve 180 of hammer 100 during the stroke of piston 160, as will be described herein. Control tube 140 includes a proximal end 145 extending into bore 114 of adapter 110, and a distal end 146 extending toward distal end 106 of barrel 102. Bore 142 extends through proximal end 145 and distal end 146 of control tube 140.

Proximal end 145 of control tube 140 includes one or more grooves 147 which are complementary to spline(s) 138 of valve member 132 of check valve 130. In some embodiments, one or more grooves 147 includes three grooves. Thus, spline(s) 138 of valve member 132 engage groove(s) 147 of control tube 140 to rotationally lock valve member 132 to control tube 140. As such, torque applied to valve member 132 is transmitted to control tube 140 via the connection between spline(s) 137 and spline(s) 138. Spline(s) 138 of valve member 132 and groove(s) 147 of control tube 140 engage in a slip fit so that valve member 132 can slide along longitudinal axis 101, thereby allowing valve member 132 to slide to open check valve 120, while still being rotationally locked to control tube 140.

Figure 8:
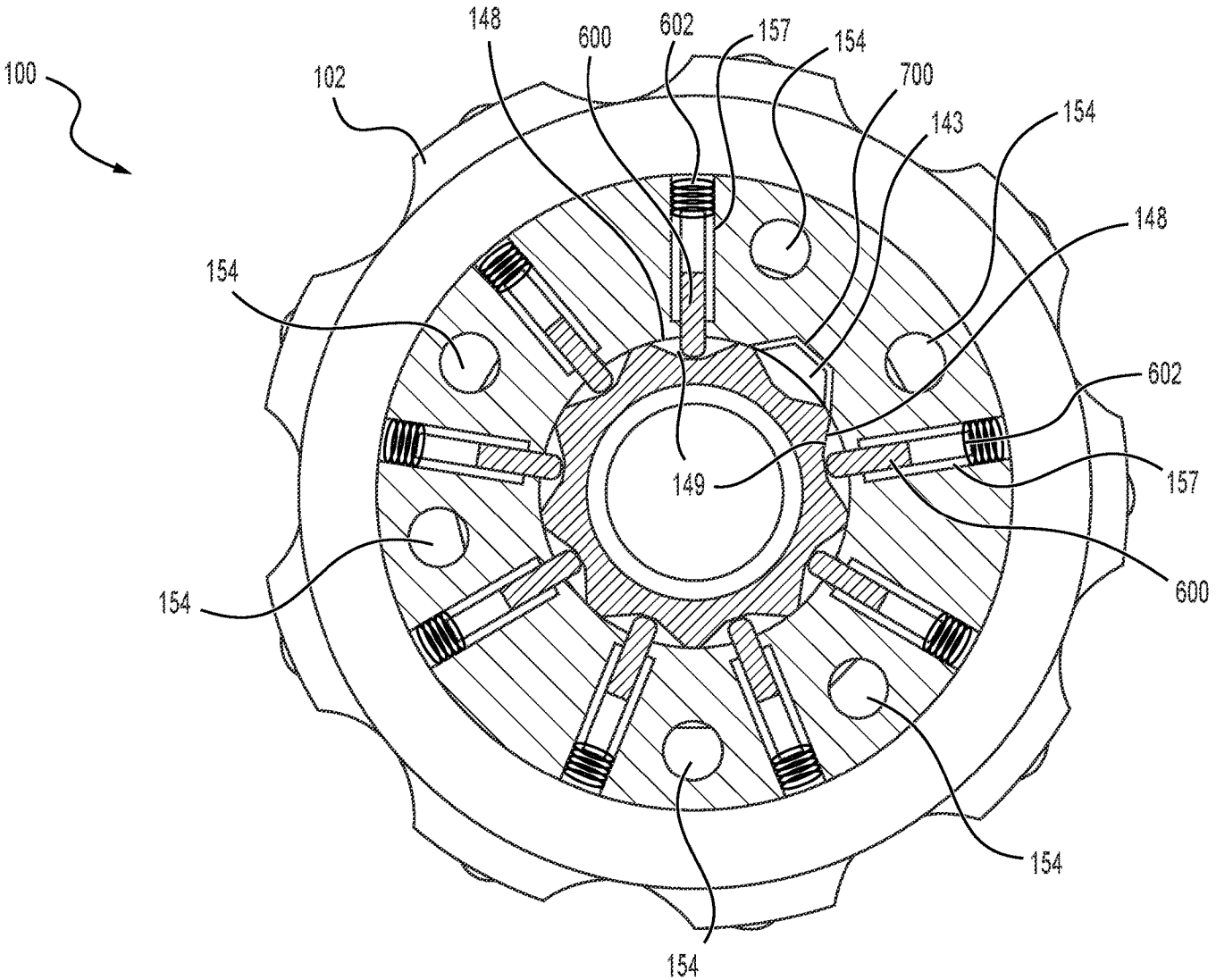
FIG. 8 is a cross-sectional view of a detent mechanism of the down-the-hole hammer of FIG. 1, taken along line 8-8 of FIG. 3.

Control tube 140 further includes one or more detent pockets 148 arranged circumferentially around an outer surface of control tube 140. In some aspects, the one or more detent pockets 148 includes nine detent pockets. Each of detent pockets 148 has a ramped or curved "V" shape or concave bottom surface 149 (as shown in FIG. 8).

Control tube 140 further includes a protrusion 143 extending radially outward from the body of control tube, which is utilized to index control tube 140 as described herein.

Referring again to FIGS. 1-3 and 8, an air distributor 150 having a bore 151 is disposed about control tube 140 and rotationally locked relative to barrel 102. Air distributor 150 includes a proximal flange 152 and a distal tube 153. At least one flange port 154 extends longitudinally through flange 152.

Figure 9A:
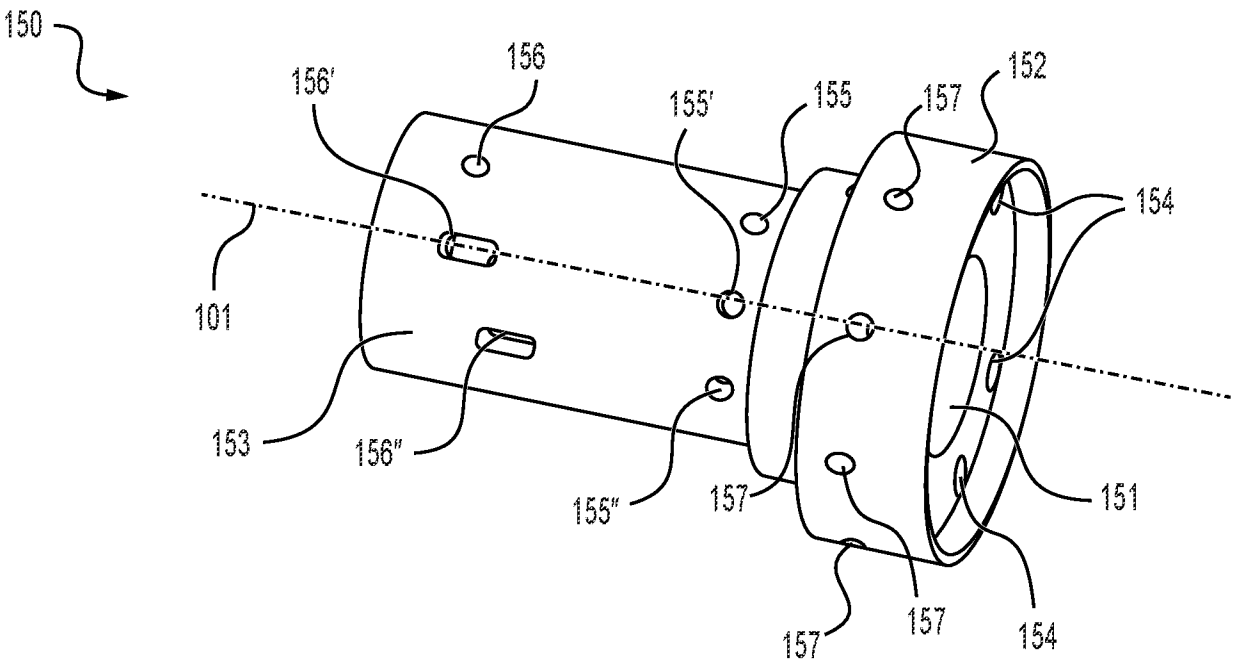
FIG. 9A is a perspective view of an air distributor of the down-the-hole hammer of FIG. 1.

Referring now to FIG. 9A, air distributor 150 further includes a plurality of sets of proximal and distal ports extending through distal tube 153 and into bore 151. In the illustrated aspect, air distributor 150 includes three sets of proximal and distal ports, namely, a first set including first proximal port 155 and first distal port 156; a second set including second proximal port 155' and second distal port 156'; and a third set including third proximal port 155" and third distal port 156". Within each set of ports, proximal port 155, 155', 155" is spaced apart from respective distal port 156, 156', 156" in a direction parallel to longitudinal axis 101. Each of proximal ports 155, 155', 155" may be circular. Each of distal ports 156, 156', 156" may be circular, as is distal port 156 in the illustrated aspect, or slot-shaped or obround, as are distal ports 156', 156" in the illustrated aspect.

The distance between proximal ports 155, 155', 155" and distal ports 156, 156', 156" may be selected to optimize operation of hammer 100 for a particular flow rate and/or pressure of air supplied to hammer 100. In particular, the distance between first proximal port 155 and first distal port 156 may be optimized for a first air flow rate/pressure, the distance between second proximal port 155' and second distal port 156' may be optimized for a second air flow rate/pressure, and the distance between third proximal port 155" and third distal port 156" may be optimized for a third air flow rate/pressure.

Air distributor 150 is disposed about control tube 140 such that only one set of ports proximal ports 155, 155', 155" and distal ports 156, 156', 156" are in fluid communication with slot 144 defined by control tube 140 at a time. Distal tube 153 of air distributor 150 is sealed against control tube 140 on either side of slot 144. Thus, whichever of ports 155, 155', 155", 156, 156', 156" are aligned with slot 144 provide the only fluid communication into and out of a chamber defined by slot 144 of control tube 140 and bore 151 of air distributor 150. As described herein, control tube 140 can be rotated relative to air distributor 150 to control which of ports 155, 155', 155", 156, 156', 156" are aligned with slot 144.

Air distributor 150 further includes one or more pin apertures 157 extending radially from longitudinal axis 101. One or more apertures 157 each house a detent pin 600 (see FIGS. 3 and 8) that is biased inward toward longitudinal axis 101, by a spring 602, so that each detent pin 600 engages one of detent pockets 148 in control tube 140. The inwardly directed biasing force of each detent pin 600 causes control tube 140 to naturally align with air distributor 150 such that detent pin(s) 600 engage the inward-most portion of ramped bottom surface 149 of respective detent pocket(s) 148.

Engagement between detent pin(s) 600 with detent pocket(s) 148 creates a limited rotational lock between control tube 140 and air distributor 150. However, if sufficient torque is applied to control tube 140, the biasing force of detent pins 600 is overcome, forcing detent pins 600 radially outward and allowing rotation of control tube 140 relative to air distributor 150. In particular, sufficient torque applied to control tube 140 causes each detent pin 600 to slide along ramped bottom surface 149 of respective detent pocket 148 until detent pin 600 is clear of detent pocket 148. Continued rotation of control tube 140 causes each detent pin 600 to engage the adjacent detent pocket 148, with the biasing force of detent pin 600 causing control tube 140 to naturally align with air distributor 150 such that detent pin(s) 600 engage the inward-most portion of ramped bottom surface 149 of respective detent pocket(s) 148.

Each of the indexable positions corresponds to one set of proximal ports 155, 155', 155" and distal ports 156, 156', 156" being in fluid communication with slot 144 of control tube 140. Though not shown in the drawing due to the illustrated orientations of hammer 100, each of ports 155, 155', 155", 156, 156', 156" has an identical port on the diametrically opposite side of air distributor 150, which aligns with a slot identical to slot 144 on the diametrically opposite side of control tube 140. Rotation of control tube 140 relative to air distributor 150, such that the detent pin(s) 600 engage the detent pocket(s) 148 in a different position, changes which set of proximal ports 155, 155', 155" and distal ports 156, 156', 156" is in fluid communication with slot 144 of control tube 140. Thus, the relationship between slot 144 of control tube 140 and ports 155, 155', 155", 156, 156', 156" of air distributor 150 form an adjustable air consumption valve. In particular, changing which of ports 155, 155', 155", 156, 156', 156" of air distributor 150 are aligned with slot 144 of control tube 140 changes the timing of opening and closing of flow control valve 180, thereby adjusting the air consumption of hammer 100.

Figure 9B:
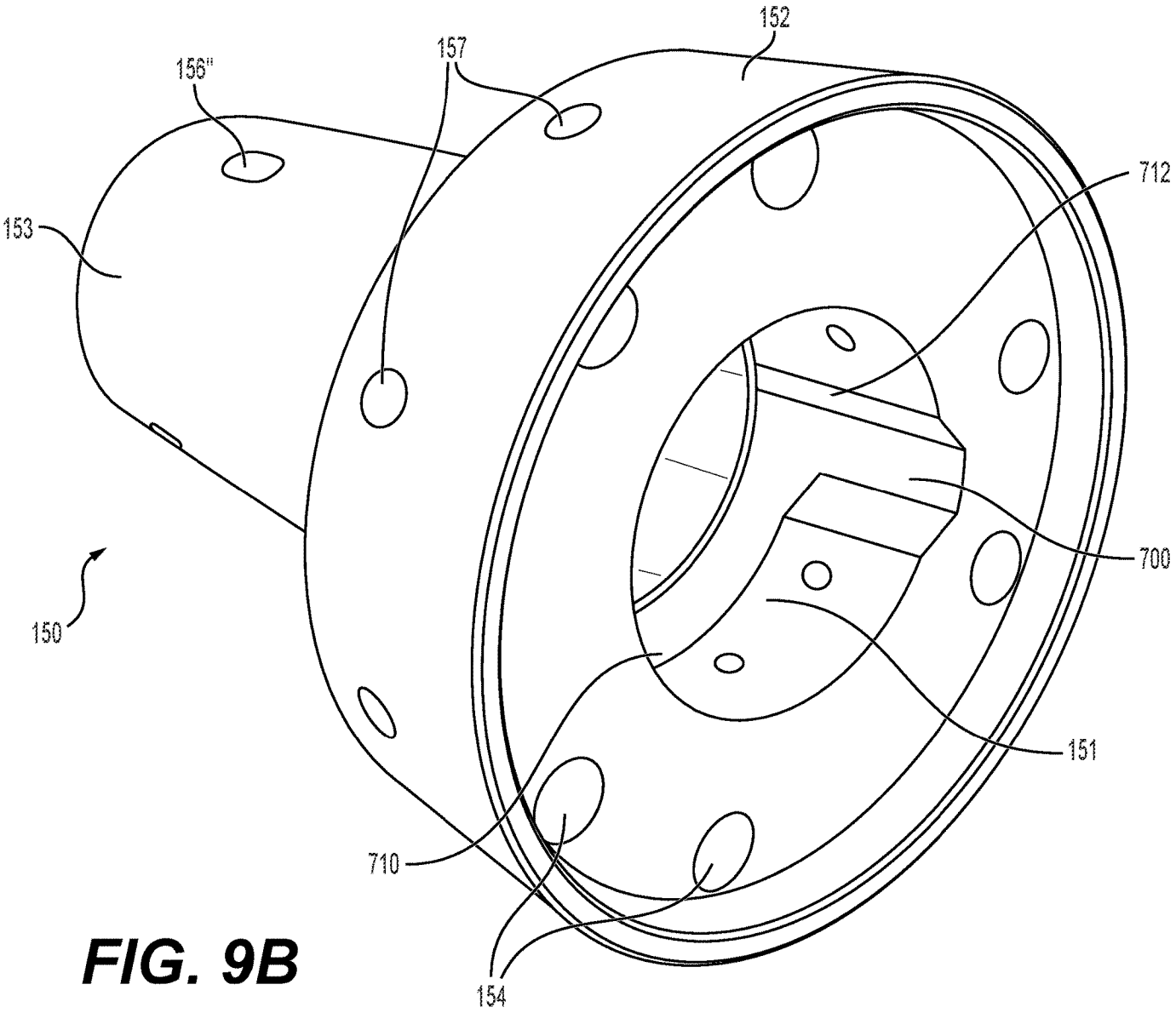
FIG. 9B is another perspective view of the air distributor of FIG. 9A.
Figure 9C:
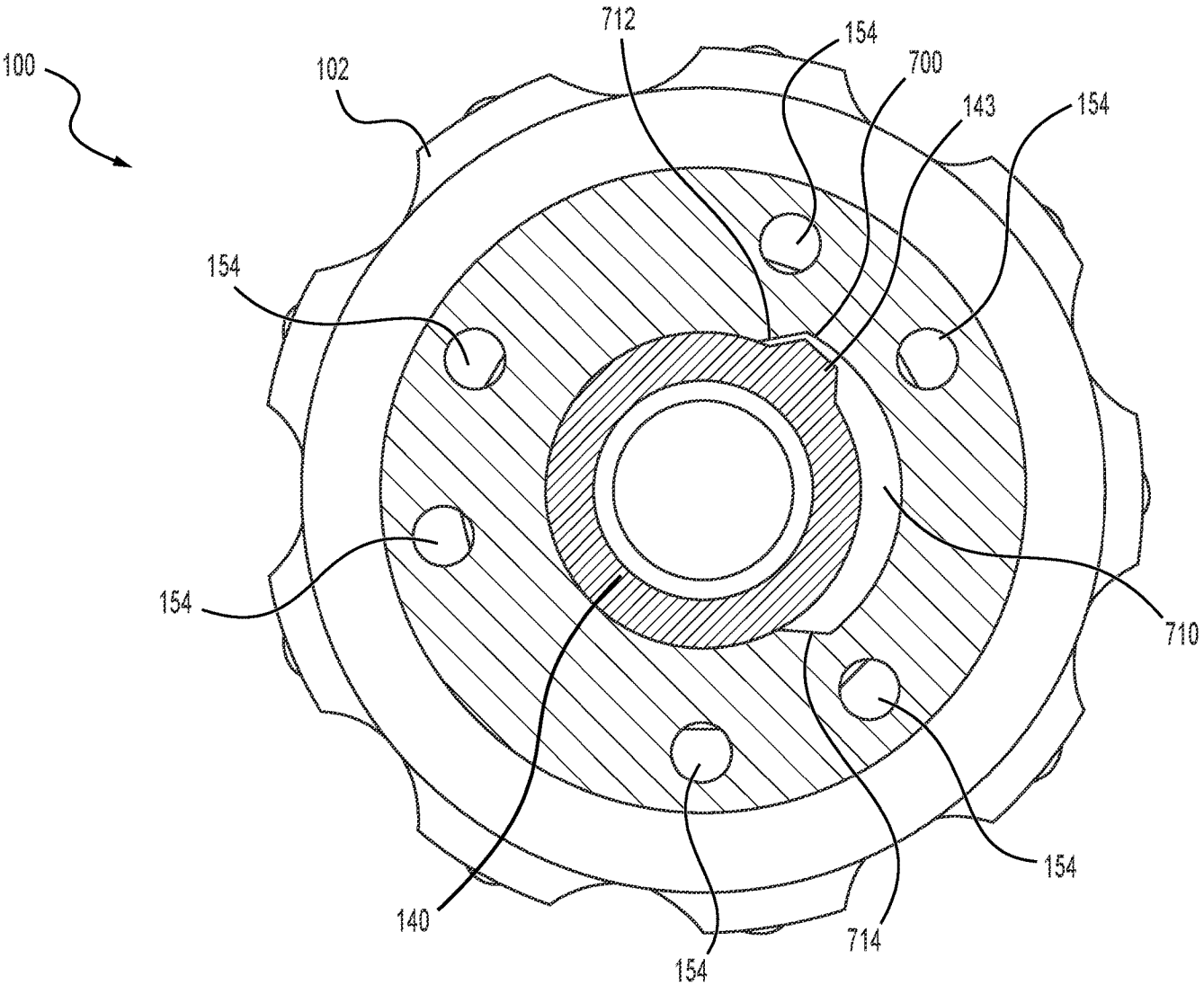
FIG. 9C is a cross-sectional view of the control tube and air distributor of the down-the-hole hammer of FIG. 1, taken along line 9C-9C of FIG. 3
Figure 12:
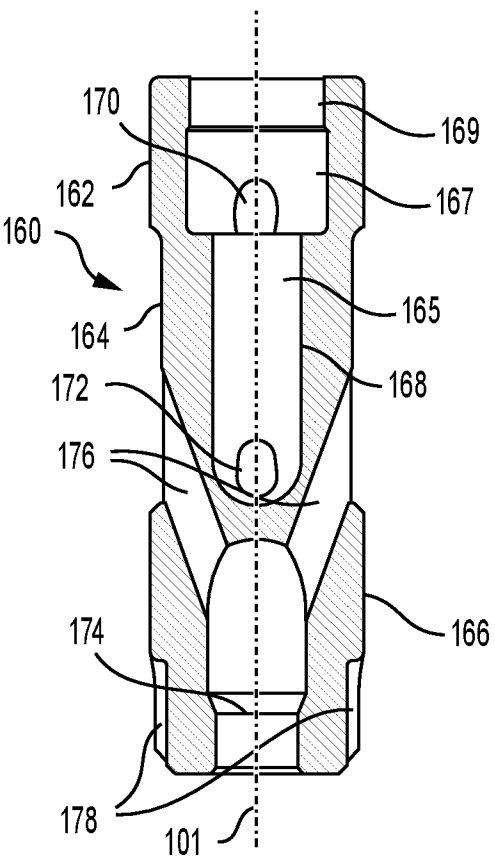
FIG. 12 is a cross-sectional side view of the piston of FIG. 10, viewed along section line 12-12 of FIG. 10.
Figure 11:
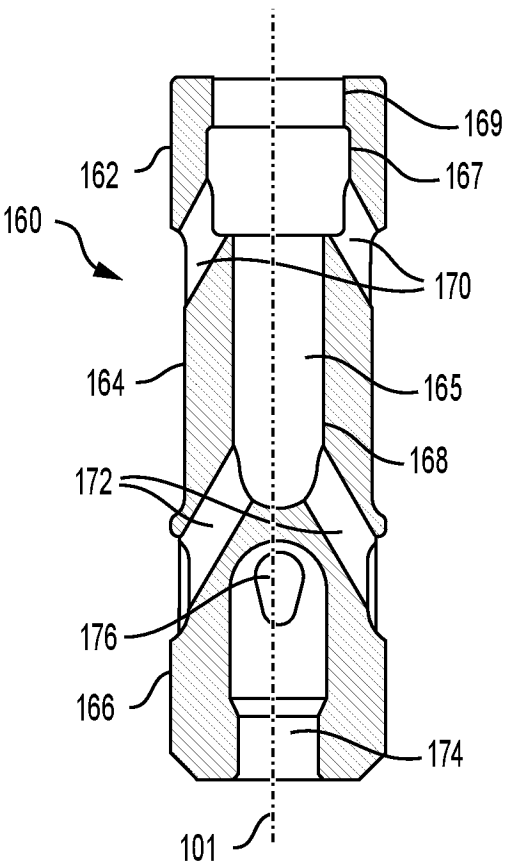
FIG. 11 is a cross-sectional side view of the piston of FIG. 10, viewed along section line 11-11 of FIG. 10.
Figure 10:
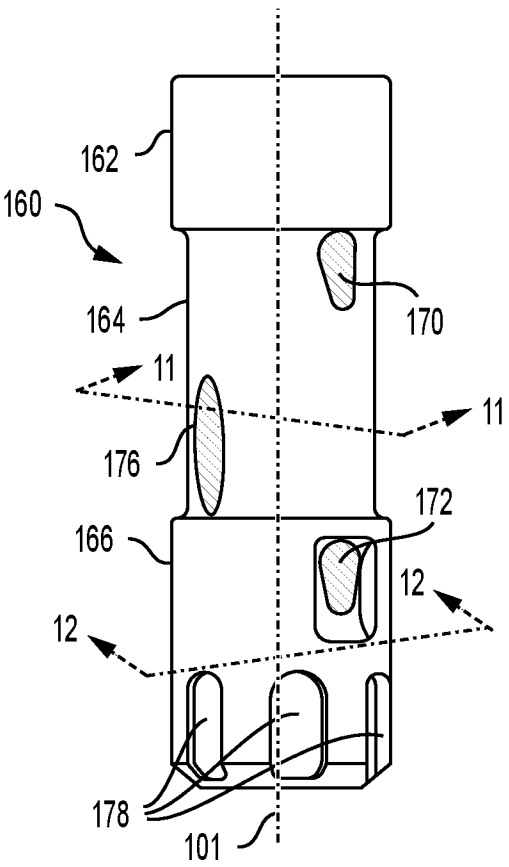
FIG. 10 is a side view of a piston of the down-the-hole hammer of FIG. 1.

Referring now to FIGS. 8, 9B, and 9C, air distributor 150 include a longitudinal groove 700 that receives protrusion 143 of control tube 140 (see FIG. 7B) to allow control tube 140 to be inserted into air distributor 150 during assembly of hammer 100. Groove 700 opens into arcuate channel 710 that is radially recessed into bore 151 of air distributor 150 and extends partially around bore 151. As shown in FIG. 9B, arcuate channel 710 begins at a sidewall 712 of groove 700 and extends clockwise around bore 151. It will be understood to those skilled in the art that arcuate channel 710 could alternatively extend counterclockwise from groove 700. As shown in FIG. 9C, arcuate channel 710 terminates at an end wall 714. Once control tube 140 is inserted into groove 700 during assembly of hammer 100, protrusion 143 of control tube 140 resides in arcuate channel 710. Control tube 140 is rotatable relative to air distributor 150 over the range of arcuate channel 710. In particular, control tube 140 can be rotated clockwise until protrusion 143 contacts end wall 714, and counterclockwise until protrusion 143 contacts sidewall 712.

With reference to FIGS. 1-3 and 10-12, a piston 160 is slidably disposed within barrel 102. Piston 160 is configured to slide parallel to longitudinal axis 101 in response to a pressure differential between opposite ends of piston 160, as will be described herein. Piston 160 includes a proximal outer surface 162 configured to create a substantially airtight seal with an internal surface of barrel 102 to prevent air flowing past piston 160. Piston 160 further includes an intermediate outer surface 164 having a smaller diameter than proximal outer surface 162 and located distally of proximal outer surface 162. Intermediate outer surface 164 defines an intermediate chamber 206 with an internal surface of barrel 102. Piston 160 further includes a distal outer surface 166 located distally of intermediate outer surface 164. Distal outer surface 166 may have substantially the same outer diameter as proximal outer surface 162, and is configured to create a substantially airtight seal with an internal surface of barrel 102 to prevent air flowing past distal outer surface 166 into and/or out of intermediate chamber 206.

Piston 160 defines a proximal internal cavity 168 configured to receive (during various operating stages of hammer 100) distal end 146 of control tube 140 and distal tube 153 of air distributor 150. Proximal internal cavity 168 includes a distal section 165 having a diameter substantially equal to an outer diameter of distal end 146 of control tube 140, an enlarged section 167 having a diameter larger than an outer diameter of distal tube 153 of air distributor 150, and a proximal lip 169 having a diameter approximately equal to an outer diameter of distal tube 153 of air distributor 150. Distal section 165 of proximal internal cavity 168 form a substantially airtight seal with distal end 146 of control tube 140 in some operational positions of hammer 100, as will be described herein. Proximal lip 169 of proximal internal cavity 168 form a substantially airtight seal with distal tube 153 of air distributor 150 in some operational positions of hammer 100, as will be described herein.

At least one first port 170 extends from enlarged section 167 of proximal internal cavity 168 to intermediate outer surface 164. At least one second port 172 extends from distal section 165 of proximal internal cavity 168 to distal outer surface 166. In some aspects, at least one first port 170 and/or at least one second port 172 include two ports, respectively, and extend at an obtuse angle from proximal internal cavity 168 toward bit 120 as shown in FIG. 3.

Piston 160 further includes one or more passageways 178 recessed into distal outer surface 166, and extending from the distal end of distal outer surface 166 toward intermediate outer surface 164. Passageway(s) 178 terminate distally of second port(s) 172. Passageway(s) 178 allow air to flow from second port(s) 172 between barrel 102 and piston 160 when second port(s) 172 are aligned with recess 108 of barrel 102, as will be described in more detail herein. In some aspects, one or more passageways 178 include six passageways spaced equally about the circumference of the piston 160.

Piston 160 further defines a distal internal cavity 174 configured to receive foot valve 124 of bit 120. Distal internal cavity 174 has a diameter substantially equal to an outer diameter of foot valve 124 such that a substantially airtight seal is formed between distal internal cavity 174 and foot valve 124 when foot valve 124 is inserted into distal internal cavity 174. At least one third port 176 extends from distal internal cavity 174 to intermediate outer surface 164 of piston 160. In some aspects, the at least on third port 176 includes two ports, and the ports extend at an obtuse angle from distal internal cavity 174 toward adapter 110.

Piston 160 is arranged inside barrel 102 so that a proximal chamber 200 is defined between a proximal end of piston 160 and a valve seat 190 of a flow control valve 180. Further, a distal chamber 202 is defined between bit 120 and a distal end of piston 160.

Referring again to FIGS. 1-3, flow control valve 180 of hammer 100 further includes a valve member 181 slidably mounted on an outer surface of air distributor 150. Valve member 181 defines a valve chamber 204 with an outer surface of air distributor 150. Valve member 181 is held captive by air distributor 150 and valve seat 190 to limit sliding of valve member 181. In particular, a distal surface 182 of valve member 181 engages a distal surface 192 of valve seat 190 to limit distal travel of valve member 181, while proximal flange 152 of air distributor 150 limits proximal travel of valve member 181.

Valve member 181 is configured to slide along longitudinal axis 101 between a first (distal) position and a second (proximal) position. In the first position (see FIG. 21A), with distal surface 182 of valve member 181 engaging distal surface 192 of valve seat 190, valve member 181 prevents air flow from adapter 110 into proximal chamber 200. In the second position (see FIG. 21B), with valve member 181 slid proximally so that distal surface 182 is spaced apart from distal surface 192 of valve seat 190, adapter 110 is in fluid communication with proximal chamber 200 via flange port 154 of air distributor 150. Thus, valve member 181 provides selective fluid communication between adapter 110 and proximal chamber 200, as will be described in greater detail herein. Valve member 181 aligns with air distributor 150 such that whichever proximal port 155, 155', 155" of air distributor 150 is aligned with slot 144 of control tube 140 is in fluid communication with valve chamber 204 regardless of the position of valve member 181 relative to air distributor 150.

INDUSTRIAL APPLICABILITY

The disclosed aspects of hammer 100 as set forth in the present disclosure may be used for breaking and/or pulverizing ground surfaces, particularly rock surfaces, during a drilling operation. Particularly, hammer 100 of the present disclosure generates repeated impact forces to break ground surfaces to advance a drill string below grade. Referring now to FIGS. 8-21B, hammer 100 is configured to generate such impact forces with bit 120 by cycling through various operational positions in response to pressurized air being supplied from a drill string (not shown) attached to adapter 110. Hammer 100 generates these impact forces by reciprocating piston 160 within barrel 102 to strike bit 120. Further, hammer 100 may be configured to rotate along with the drill string attached to adapter 110 to enhance drilling efficiency.

Further, hammer 100 may be adjusted in order to be optimized for various air flow rates and/or pressures to enhance drilling efficiency.

For the purposes of the following description of FIGS. 13-21B, it is assumed that control tube 140 is rotated relative to air distributor 150 such that first proximal port 155 and first distal port 156 are aligned with slot 144 of control tube 140. As will be appreciated from the following description, essential operation of hammer 100 would not change is other ports 155', 155", 156', 156" are aligned with slot 144 of control tube 140, but the timing at which hammer changes certain operational positions would be altered.

Figure 13:
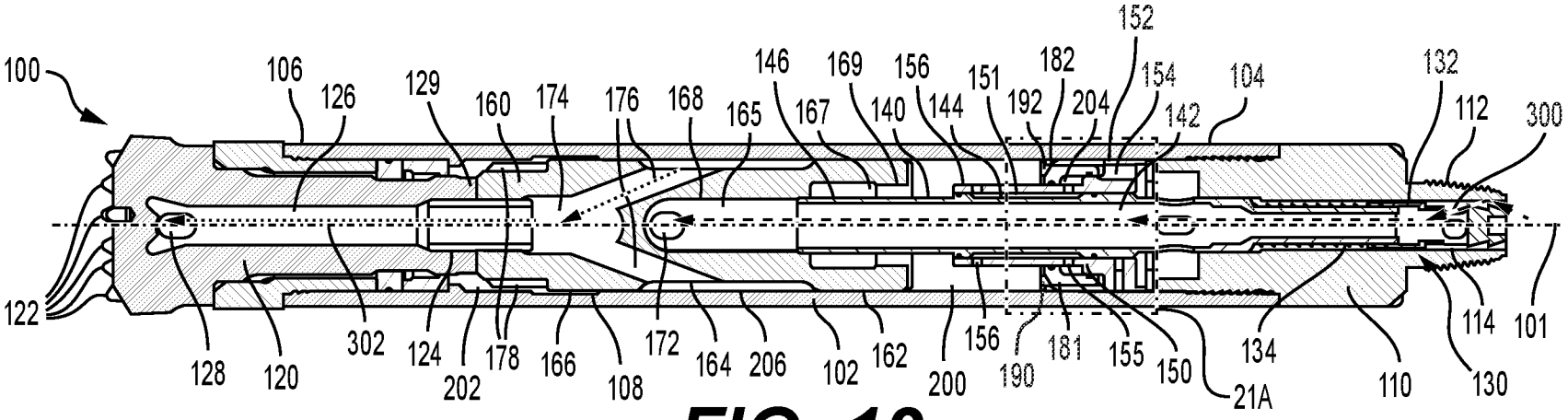
FIG. 13 is a cross-sectional side view of the down-the-hole hammer of FIG. 1 in a first operating position, viewed along section line 3-3 of FIG. 1.
Figure 14:
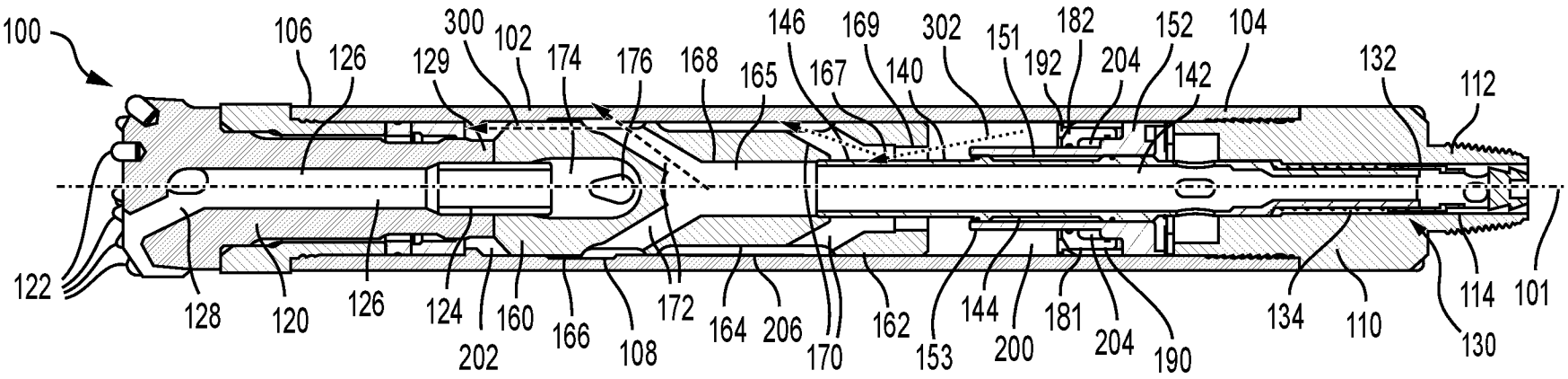
FIG. 14 is a cross-sectional view of the down-the-hole hammer of FIG. 1 in the first operating position, viewed along section line 14-14 of FIG. 1.

Referring now to FIGS. 13 and 14, in a first operational position, piston 160 abuts strike face 129 of bit 120. First operational position may correspond to piston 160 having just delivered an impact to bit 120. Pressurized inlet air supplied to adapter 110 (e.g., via an external compressor) can flow through hammer 100 along the path indicated by arrow 300. In particular, the inlet air depresses valve member 132 of check valve 130, allowing the inlet air to flow around check valve 130 into bore 142 of control tube 140. Control tube 142 is received in proximal internal cavity 168 of piston 160, so the air enters proximal internal cavity 168. From proximal internal cavity 168, the inlet air flows through second port(s) 172. With piston 160 abutting bit 120, second port(s) 172 are aligned with recess 108 of barrel 102. Thus, the inlet air can flow out of second port(s) 172, into recess 108, through passageway(s) 178 and into distal chamber 202 of barrel 102.

Figure 21A:
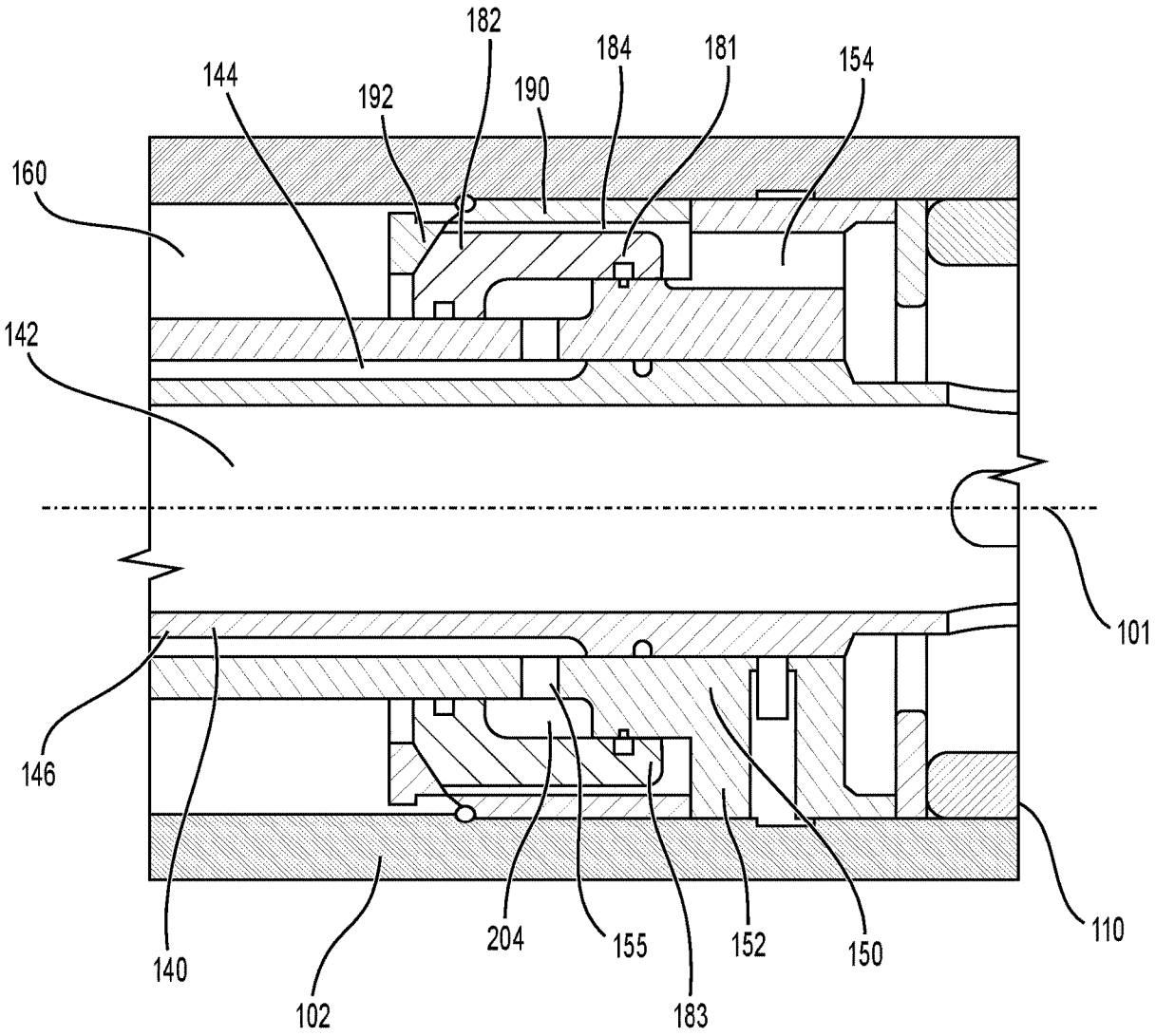
FIG. 21A is a detail view of a flow control valve and associated components of detail 21A of FIG. 13.

The combined effect of air pressure in flange port 154, air pressure in proximal chamber 200, and air pressure in valve chamber 204 maintains valve element 181 of flow control valve 180 in the first (distal) position so that distal surface 182 of valve member 181 engages distal surface 192 of valve seat 190. An enlarged, detail view of flow control valve 180 and associated components, in the first operational position of hammer 100, is illustrated in FIG. 21A. While air flowing past valve member 132 can reach flange port 154 of air distributor 150, air cannot flow past valve element 181 and therefore cannot flow into proximal chamber 200. More particularly, air can flow no farther than a gap 184 between an outer surface of valve element 181 and valve seat 190, as engagement of distal surface 182 of valve member 181 with distal surface 192 of valve seat 190 prevents further airflow toward proximal chamber 200.

Concurrently with the inlet air flowing in the direction of arrow 300, exhaust air exits hammer 100 by flowing in the direction of arrow 302. The exhaust air constitutes the air present in proximal chamber 200 of barrel 102 which must be evacuated to complete a stroke of hammer 100. The exhaust air flows between control tube 140 and proximal lip 169 of proximal internal cavity 168 of piston 160, and into enlarged section 167 of proximal internal cavity 168. The outer diameter of control tube 140 forms a seal with distal section 165 of proximal inner cavity, so the exhaust air cannot flow from enlarged section 167 around the outside of control tube 140 into distal section 165. Rather, the exhaust air flows through first port(s) 170 into intermediate chamber 206, and then from intermediate chamber 206 through third port(s) 176 and into distal internal cavity 174 of piston 160. From distal internal cavity 174, the exhaust air flow through bore 126 in foot valve 124 and bit 120, and out of exhaust port 128.

As the inlet air fills distal chamber 202 of barrel 102 at the same time the exhaust air is able to flow out of proximal chamber 200, a pressure differential is created between proximal chamber 200 and distal chamber 202. Particularly, air pressure in distal chamber 202 increases and exceeds air pressure in proximal chamber 200. This pressure differential induces piston 160 to slide proximally away from bit 120, as shown in FIGS. 15 and 16.

Figure 15:
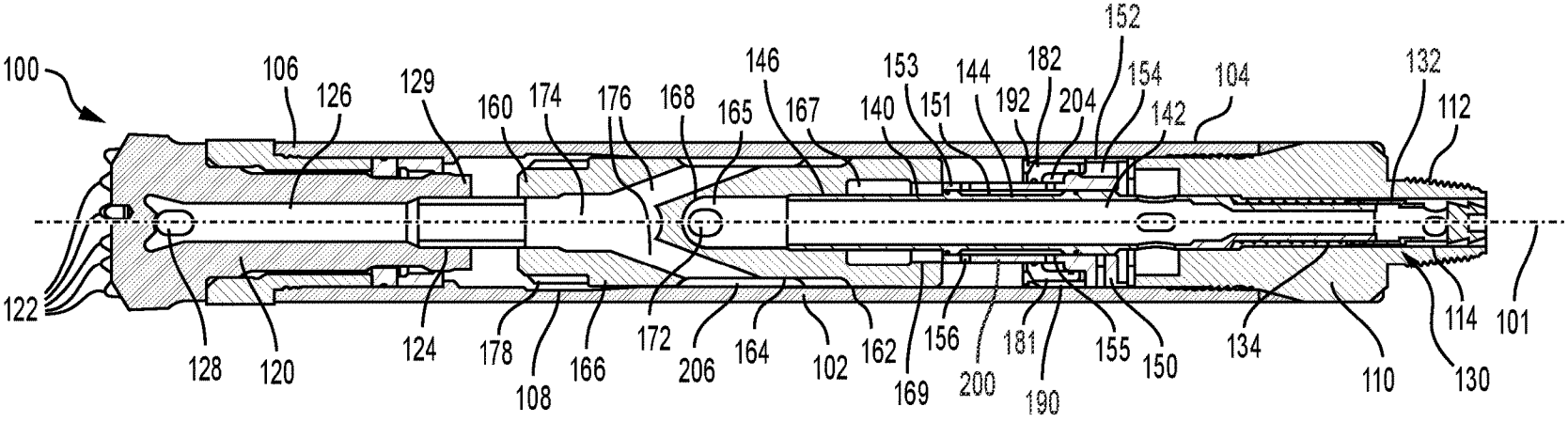
FIG. 15 is a cross-sectional side view of the down-the-hole hammer of FIG. 1 in a second operating position, viewed along section line 3-3 of FIG. 1.
Figure 16:
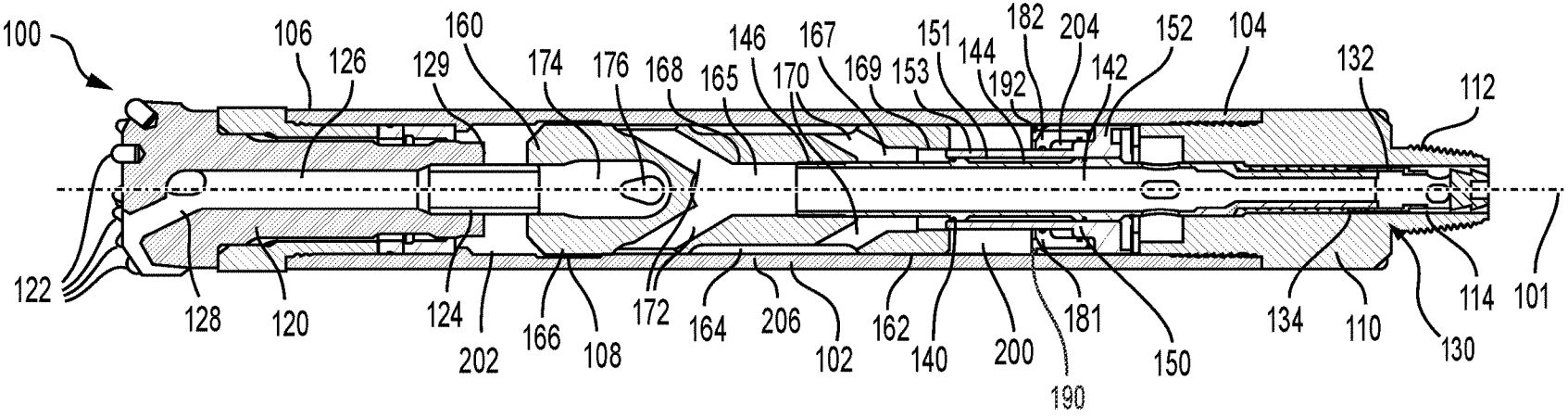
FIG. 16 is a cross-sectional side view of the down-the-hole hammer of FIG. 1 in the second operating position, viewed along section line 14-14 of FIG. 1.

Referring now to FIGS. 15 and 16, a second operational position of hammer 100 is illustrated. In second operational position, piston 160 slides proximally in barrel 102 along longitudinal axis 101. As piston 160 slides, second port(s) 172 move out of alignment with recess 108 of barrel 102, causing second port(s) 172 to be choked by the inner sidewall of the barrel 102. As such, inlet air is no longer able to flow out of second ports(s) 172, into recess 108, through passageway(s) 178, and into distal chamber 202. Thus, no additional air enters distal chamber 202. However, inertia of piston 160 causes piston 160 to continue to slide proximally toward adapter 110, which causes the air in distal chamber 202 to expand, and therefore reduce in pressure.

Also as piston 160 slides proximally in barrel 102, distal tube 153 of air distributor 150 engages proximal lip 169 of proximal internal cavity 168 of piston 160. Because proximal lip 169 has an inner diameter substantially equal to the outer diameter of distal tube 153 of air distributor 150, air is unable to flow between proximal lip 169 and air distributor 150. As such, proximal chamber 200 of barrel 102 becomes choked as air can no longer flow out of proximal chamber 200 into proximal internal cavity 168. Therefore, as inertia causes piston 160 to slide proximally, the air trapped in proximal chamber 200 is compressed and increases in pressure.

In second operational position of FIGS. 15 and 16, foot valve 124 remains partially inserted into distal internal cavity of piston 160, so air in distal chamber 202 cannot escape distal chamber 202 to bore 126.

Figure 17:
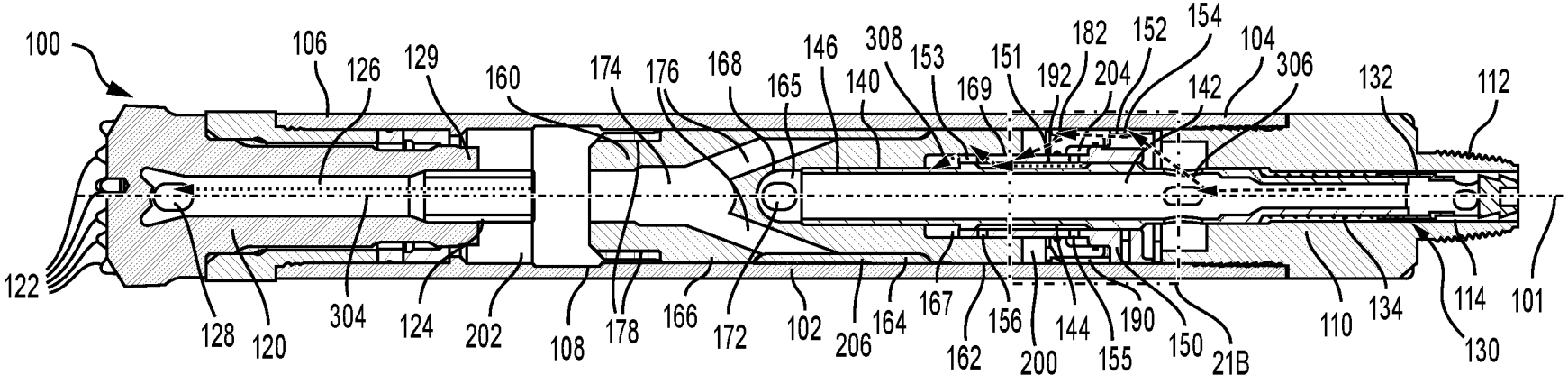
FIG. 17 is a cross-sectional side view of the down-the-hole hammer of FIG. 1 in a third operating position, viewed along section line 3-3 of FIG. 1.
Figure 18:
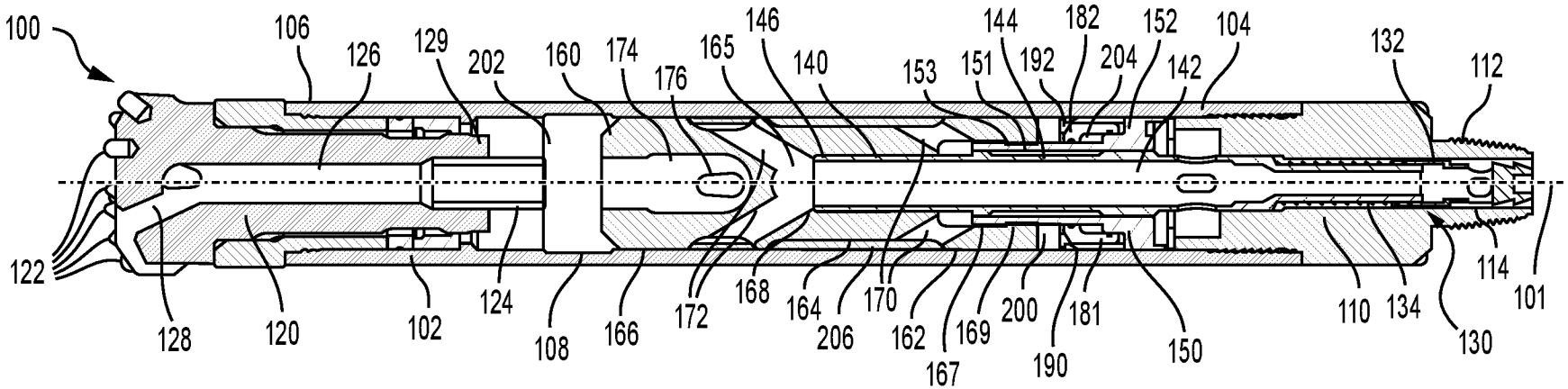
FIG. 18 is a cross-sectional side view of the down-the-hole hammer of FIG. 1 in the third operating position, viewed along section line 14-14 of FIG. 1.

Referring now to FIGS. 17 and 18, a third operational position of hammer 100 is illustrated. As piston 160 continues to slide proximally due to inertia of piston 160, the inner diameter of piston 160 clears foot valve 124. Thus, air previously trapped in distal chamber 202 may escape through bore 126 of foot valve 124 and bit 120, and ultimately exit hammer 100 through exhaust port 128, as illustrated by arrow 304 in FIG. 17. Proximal sliding of piston 160 further causes first distal port 156 of air distributor 150 to clear proximal lip 169 of proximal internal cavity 168 of piston 160. First distal port 156 is thus in fluid communication with enlarged section 167 of proximal internal cavity 168. Exhaust air trapped in valve chamber 204 can therefore flow through first proximal port 155 of air distributor 150, through bore 151, out first distal port 156, and into enlarged section 167 of proximal internal cavity 168. This exhaust air flow is illustrated by arrow 308 in FIG. 17. The exhaust air in enlarged section 167 flows out of first port(s) 170 into intermediate chamber 206, and through third port(s) 176 into distal internal cavity 174, from where the exhaust air meets and joins with the exhaust air flowing out of distal chamber 202 (i.e., in the direction of arrow 304) to exhaust port 128.

Figure 21B:
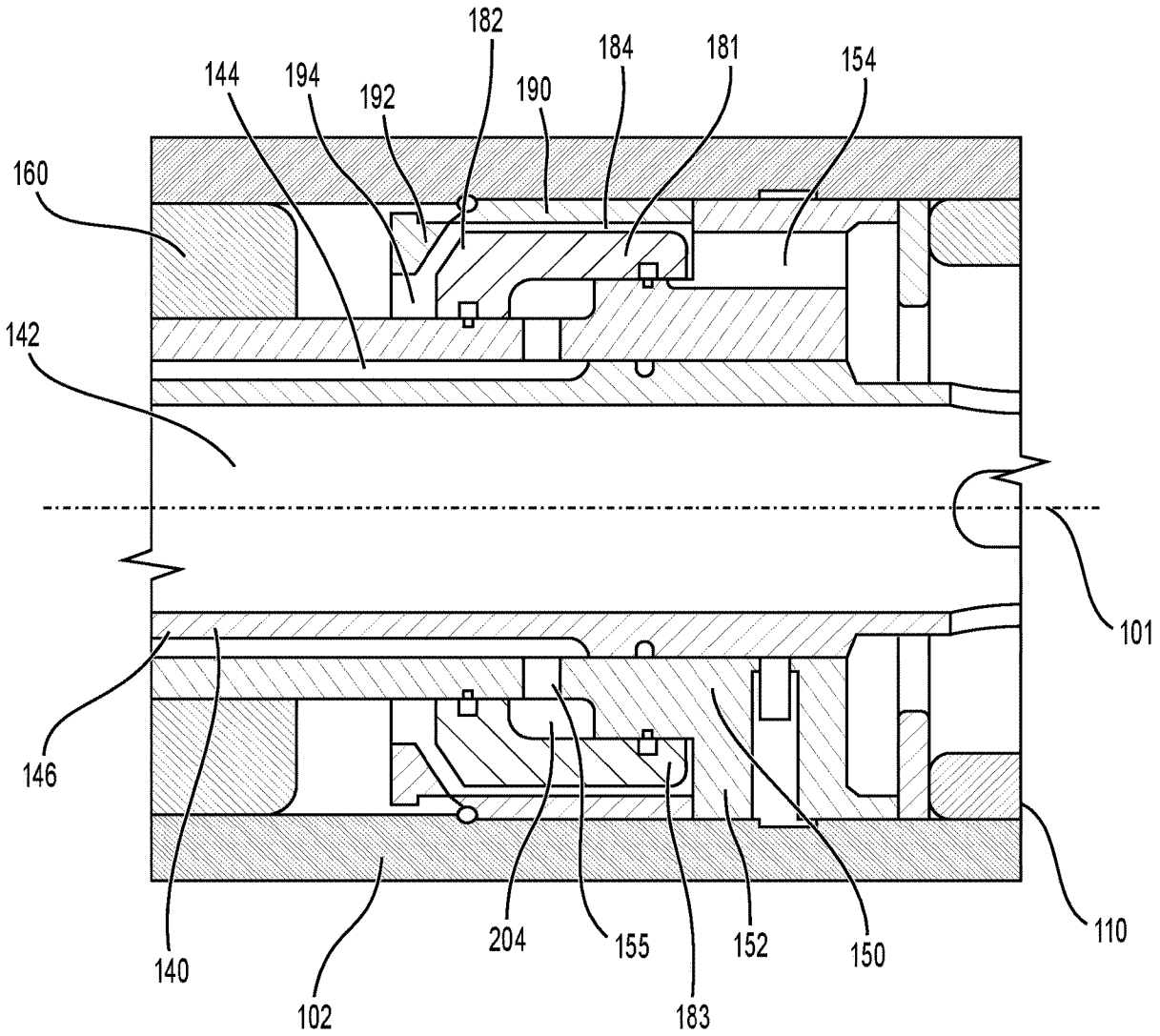
FIG. 21B is a detail view of a flow control valve and associated components of detail 21B of FIG. 17.

An enlarged, detail view of flow control valve 180 and associated components, in the third operational position of hammer 100, is illustrated in FIG. 21B. As shown in FIGS. 17, 18, and 21B, valve member 181 slides proximally until a proximal end 183 of valve member 181 contacts proximal flange 152 of air distributor 150. Flange port 154 of air distributor 150 are located at least partially radially outward of valve member 181, so that air can flow through flange port 154 and around the outside of valve member 181 even when proximal end 183 of valve member 181 is in contact with proximal flange 152 of air distributor. In particular, air can flow through flange port 154 into gap 184 (see FIG. 21B) between outer surface of valve member 181 and valve seat 190. Thus, in the third operational position of hammer 100, inlet air supplied to adapter 110 can flow through flange port 154 of air distributor 150 around valve member 181 (via gap 184), between distal surface 182 of valve member 181 and distal surface 192 of valve seat 190, and through a space 194 between valve seat 190 and air distributor 150 into proximal chamber 200. This inlet air flow is illustrated by arrow 306 in FIG. 17.

Referring again to FIGS. 17 and 18, proximal sliding of piston 160 further causes first distal port 156 of air distributor 150 to clear proximal lip 169 of proximal internal cavity 168 of piston 160. First distal port 156 is thus in fluid communication with enlarged section 167 of proximal internal cavity 168. Exhaust air trapped in valve chamber 204 can therefore flow through first proximal port 155 of air distributor 150, through bore 151, out first distal port 156, and into enlarged section 167 of proximal internal cavity 168. This exhaust air flow is illustrated by arrow 308 in FIG. 17. The exhaust air in enlarged section 167 flows out of second port(s) 172 into intermediate chamber 206, and through third port(s) 176 into distal internal cavity 174, from where the exhaust air meets and joins with the exhaust air flowing out of distal chamber 202 (i.e., in the direction of arrow 304) to exhaust port 128.

As will be appreciated from FIG. 17, the location of first distal port 156 on air distributor 150 governs how far proximally piston 160 must slide before first distal port 156 enters enlarged section 167 of proximal internal cavity 168. Thus, the stroke of piston 160 changes depending on whether first distal port 156, second distal port 156', or third distal port 156" is aligned with slot 144 of control tube 140.

With continued reference to FIGS. 17 and 18, the inlet air flowing into proximal chamber 200 (along arrow 306) increases the pressure in proximal chamber 200. Conversely, the air pressure in distal chamber 202 is substantially at atmospheric pressure because the exhaust air in distal chamber 200 is free to vent through bore 126 of foot valve 124 and bit 120 to exhaust port 128. Thus, a pressure differential is created between proximal chamber 200 and distal chamber 202, with proximal chamber 200 having a higher air pressure than distal chamber 202. The relatively higher air pressure in proximal chamber 200 acts against the proximal face of piston 160, causing piston 160 to decelerate and eventually stop before contacting valve seat 190 (and/or or other components proximal of piston 160) at the proximal end of the piston stroke. That is, the inlet air in proximal chamber 200 acts as a cushion to bring piston 160 to a controlled stop. Once piston 160 has stopped sliding proximally, the inlet air in proximal chamber 200 continues to act against the proximal face of piston 160 to cause piston 160 to slide back toward bit 120, as shown in FIGS. 19 and 20.

Figure 19:
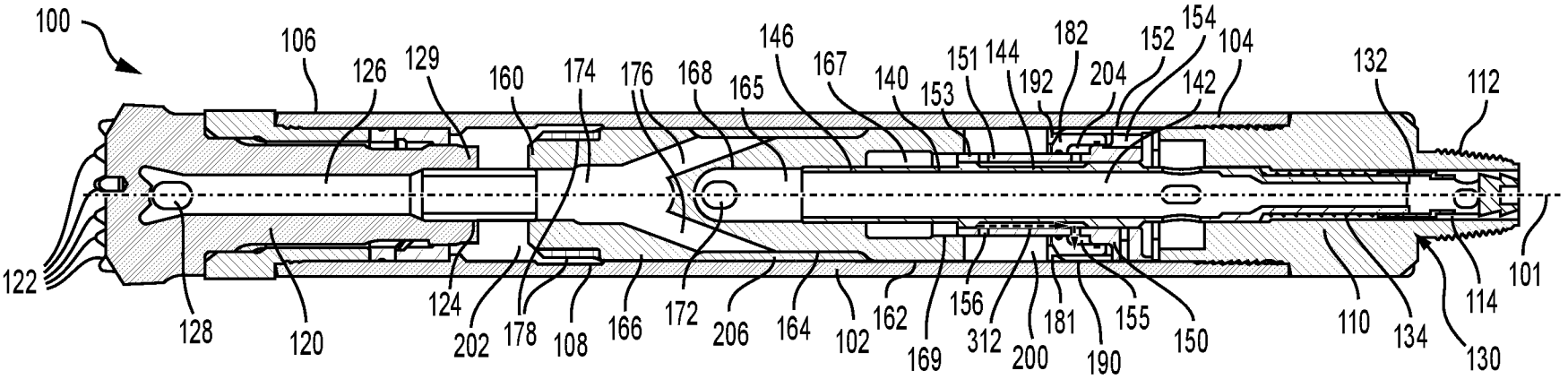
FIG. 19 is a cross-sectional view of the down-the-hole hammer of FIG. 1 in a fourth operating position, viewed along section line 3-3 of FIG. 1.
Figure 20:
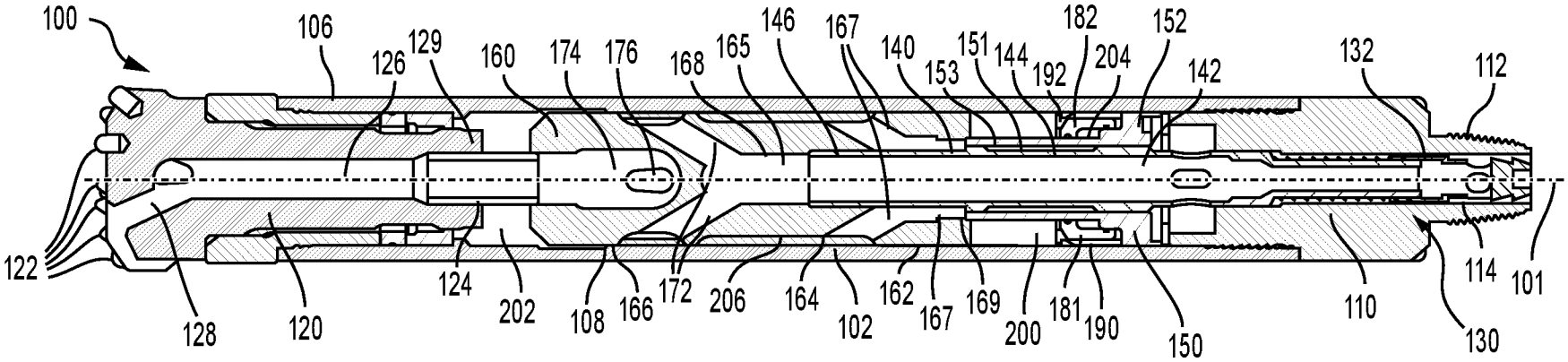
FIG. 20 is a cross-sectional view of the down-the-hole hammer of FIG. 1 in the fourth operating position, viewed along section line 14-14 of FIG. 1.

Referring now to FIGS. 19 and 20, a fourth operational position of hammer 100 is illustrated, in which piston 160 again slides toward bit 120 due to pressure in proximal chamber 200. As piston 160 slides toward bit 120, proximal lip 169 of piston 160 clears first distal port 156 of air distributor 150, placing first distal port 156 into fluid communication with proximal chamber 200. This allows inlet air in proximal chamber 200 to flow into bore 151 of air distributor 150 and out first proximal port 155 of air distributor 150 into valve chamber 204, as illustrated by arrow 312 of FIG. 19. As the volume of air in valve chamber 204 increases, valve member 181 slides distally to increase the volume of valve chamber 204 to accommodate more air. Valve member 181 continues to slide distally until distal surface 182 of valve member 181 contacts distal surface 192 of valve seat 190, thereby closing the flow path between valve member 181 and valve seat 190 and thus closing air flow into chamber 200.

As piston 160 continues to slide distally in barrel 102, foot valve 124 is received by distal internal cavity 174, which isolates distal chamber 202 of barrel 102 from bore 126 of foot valve 124 and bit 120. As such, exhaust air is temporarily unable to flow from distal chamber 202 to exit port 128, causing a pressure increase in distal chamber 202. As piston 160 continues to move distally in barrel 102, piston eventually impacts strike face 129 of bit 120. Additionally, second port(s) 172 align with recess 108 of barrel 102, providing fluid communication between distal chamber 202 and second port(s) 172 via passageway(s) 178. Thus, hammer 100 is back at first operational position shown in FIGS. 13 and 14, at which point air can flow into distal chamber 202 from control tube 140 via second port(s) 172 and passageway(s) 178.

As will be appreciated from the above description, the transition between the second operational position of FIGS. 15-16 and the third operational positional of FIGS. 17-18 is governed in part by the time at which distal port 156 of air distributor 150 enters proximal internal cavity 168 of piston 160. Thus, the time at which piston transitions from moving upstream toward the proximal end and downstream toward the distal end is governed by which of distal ports 156, 156', 156" is in fluid communication with slot 144 of control tube 140. Consequently, because sliding of valve member 181 is ultimately dependent on time at which distal port 156 of air distributor 150 enters proximal internal cavity 168, which of distal ports 156, 156', 156" is in fluid communication with slot 144 of control tube 140 effects the timing at which valve member 181 slides proximally to allow air flow into proximal chamber (as shown in FIGS. 17, 18, and 21B).

Hammer 100 repeats the cycle through first, second, third, and fourth operational positions, as described herein, so long as pressurized air is supplied to adapter 110.

Figure 22:
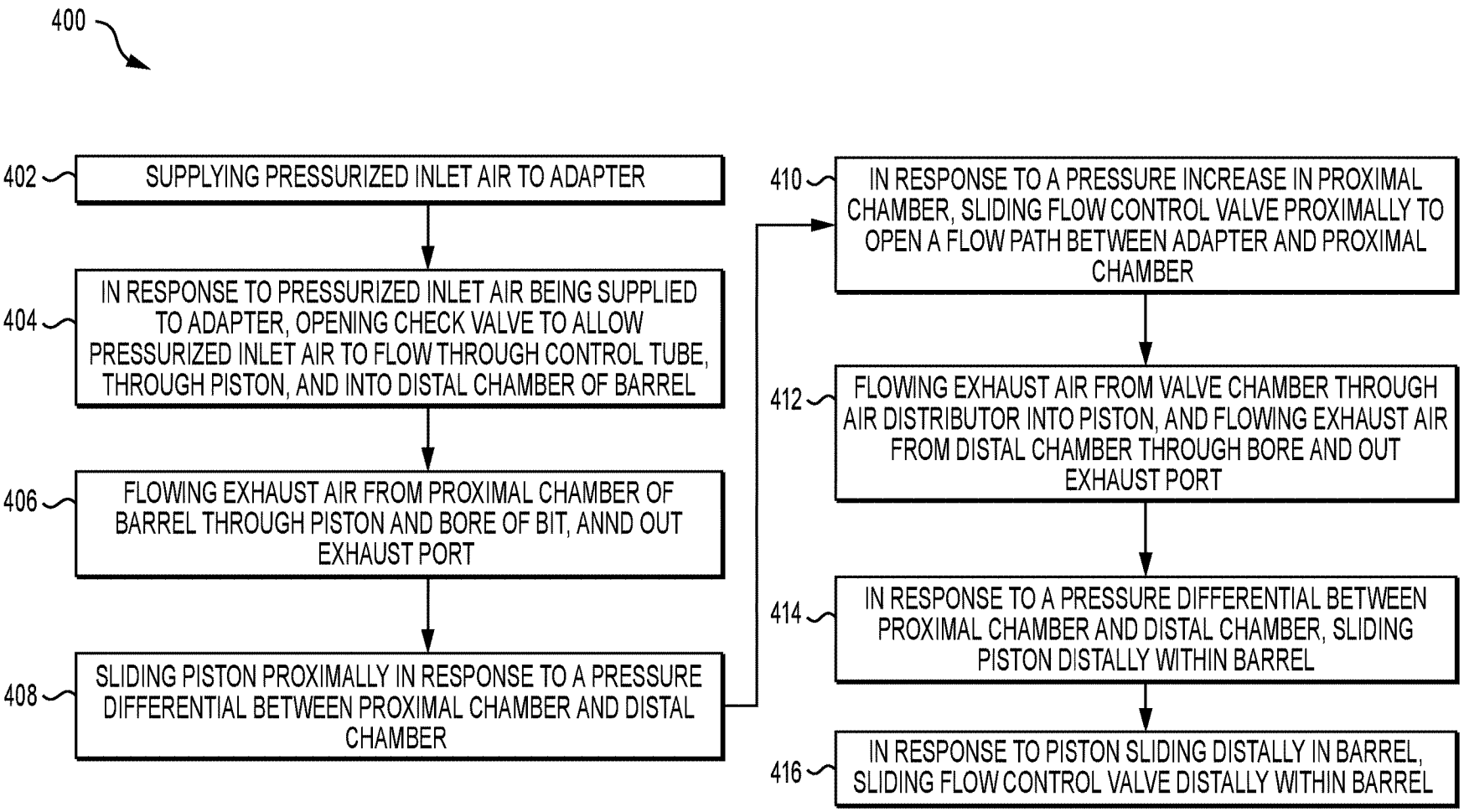
FIG. 22 provides a flowchart depicting an exemplary method for operating a down-the-hole hammer, according to aspects of the present disclosure.

FIG. 22 is a flow diagram illustrating an exemplary method 400 for operating hammer 100 to drill a hole, by cycling hammer through the first, second, third, and fourth operational positions of FIGS. 13-21B. Steps 402-416 of method 400 may be performed automatically in response to a continuous supply of pressurized air to hammer 100. Method 400 includes, at step 402, supplying pressurized inlet air to adapter 110 of hammer 100. Pressurized air may be supplied by a remotely mounted compressor and fed through drill string attached to adapter 110.

Method 400 further includes, at step 404, in response to pressurized inlet air being supplied to adapter 110 at step 402, opening check valve 130 to allow pressurized inlet air to flow through control tube 140, through piston 160, and into distal chamber 202 of barrel 102. Opening check valve 130 may occur automatically in response to inlet air exerting a predetermined pressure on valve member 132 of check valve 130. The pressurized inlet air may flow in the direction of arrow 300 of FIGS. 13 and 14, as described herein. In flowing through piston 160, the pressurized inlet air may flow into proximal internal cavity 168 from control tube 140, through second port(s) 172 to recess 108 of barrel 102, and through passageway(s) 178 to reach distal chamber 202.

Method 400 further includes, at step 406, flowing exhaust air from proximal chamber 200 of barrel 102 through piston 160 and bore 126 of bit 120, and out exhaust port 128. The exhaust air may flow in the direction of arrow 302 of FIGS. 13 and 14. In flowing through piston 160, the exhaust air flows into enlarged section 167 of proximal internal cavity 168, through first port(s) 170 into intermediate chamber 206, and through third port(s) 176 into distal internal cavity 174 to bore 126. From bore 126, the exhaust air is free to flow to exhaust port 128 and escape to the atmosphere.

Step 406 may occur concurrently with, or overlap in time with, step 404. Steps 404 and 406 correspond to hammer 100 being in the first operational position of FIGS. 13 and 14, as described herein.

Method 400 further includes, at step 408, sliding piston 160 proximally along longitudinal axis 101 in response to a pressure differential between proximal chamber 200 and distal chamber 202. In particular, distal chamber 202 increases in pressure relative to proximal chamber due to inlet air flowing into distal chamber 202 at step 404, and exhaust air flowing out of proximal chamber 200 at step 406. Step 408 corresponds to hammer 100 being in the second operational position of FIGS. 15 and 16, as described herein.

Method 400 further includes, at step 410, in response to a pressure increase in proximal chamber 200, sliding valve member 181 proximally to open a flow path between adapter 110 and proximal chamber 200. The pressure increase in proximal chamber 200 results from piston 160 continuing to slide proximally in barrel 102 due to the pressure differential between proximal chamber 200 and distal chamber 202, as described with reference to step 408. The increased pressure in proximal chamber 200 forces valve member 181 proximally away from distal surface 192 of valve seat 190. Inlet air is thus able to flow past check valve 130, though flange port 154 of air distributor 150, between valve member 181 and valve seat 190, and into proximal chamber 200, as illustrated by arrow 306 of FIG. 17.

Method 400 further includes, at step 412, flowing exhaust air from valve chamber 204 through air distributor 150 into piston 160, and flowing exhaust air from distal chamber 202 through bore 126 and out exhaust port 128. Flowing exhaust air from valve chamber 204 may occur in response to valve chamber 204 being pressurized (i.e., reduced in volume) by proximal sliding of valve member 181 at step 410. The exhaust air flows, in particular, from valve chamber 204 through proximal port(s) 155 of air distributor 150, through bore 151 of air distributor within slot 144 of control tube 140, through distal port(s) 156 of air distributor 150, and into proximal internal cavity 168 of piston 160. That is, the exhaust air flows in the direction of arrow 308 of FIG. 17. Moreover, the exhaust air within distal chamber 202 flows through bore 126 and out exhaust port 128, in the direction of arrow 304 of FIG. 17.

Step 412 may occur concurrently with, or overlap in time with, step 410. Steps 410 and 412 correspond to hammer 100 being in the third operational position of FIGS. 17, 18, and 21B, as described herein.

Method 400 further includes, at step 414, in response to a pressure differential between proximal chamber 200 and distal chamber 202, sliding piston 160 distally within barrel 102. In particular, pressure in proximal chamber 200 is greater than pressure in distal chamber 202 due to inlet airflow into proximal chamber 200 (at step 410) and exhaust airflow out of distal chamber 202 (at step 412). Thus, the relatively higher pressure in proximal chamber 200 forces piston 160 to slide distally within barrel 102, eventually causing piston 160 to impact strike face 129 of bit 120.

Method 400 further includes, at step 416, in response to piston 160 sliding distally in barrel 102, sliding valve member 181 distally within barrel 102. Particularly, once piston 160 slides clear of distal port(s) 156 of air distributor 150 during step 414, distal port(s) 156 is in fluid communication with proximal chamber 200. Inlet air flowing into proximal chamber 200 flows through distal port(s) 156, into bore 151 of air distributor 150, out proximal port(s) 155 of air distributor 150, and into valve chamber 204, in the direction of arrow 312 of FIG. 19. The subsequent increase in air volume in valve chamber 204 causes valve member 181 to slide distally, which increases the volume of valve chamber 204. As a result of valve member 181 sliding distally, distal surface 182 of valve member 181 engages distal surface 192 of valve seat 190, thereby preventing further flow of inlet air from flange port 154 or air distributor 150 into proximal chamber 200.

Step 416 may occur concurrently with, or overlap in time with, step 414. Steps 414 and 416 correspond to hammer 100 being in the fourth operational position of FIGS. 19 and 20, as described herein. As mentioned, piston 160 continues to slide distally at step 414 until piston 160 impacts strike face 129, thus returning hammer 100 to first operational position of FIGS. 13 and 14.

Steps 402-416 of method 400 are then repeated as long as pressurized air is supplied to adapter 110. As such, an impact force is repeatedly applied to strike face 129 of bit 120, and the impact force is in turn transferred to the ground/rock surface engaged by digging feature(s) 122 of bit 120. Repetition of method 400 thus causes hammer 100 to drill into ground/rock surface.

Figure 23:
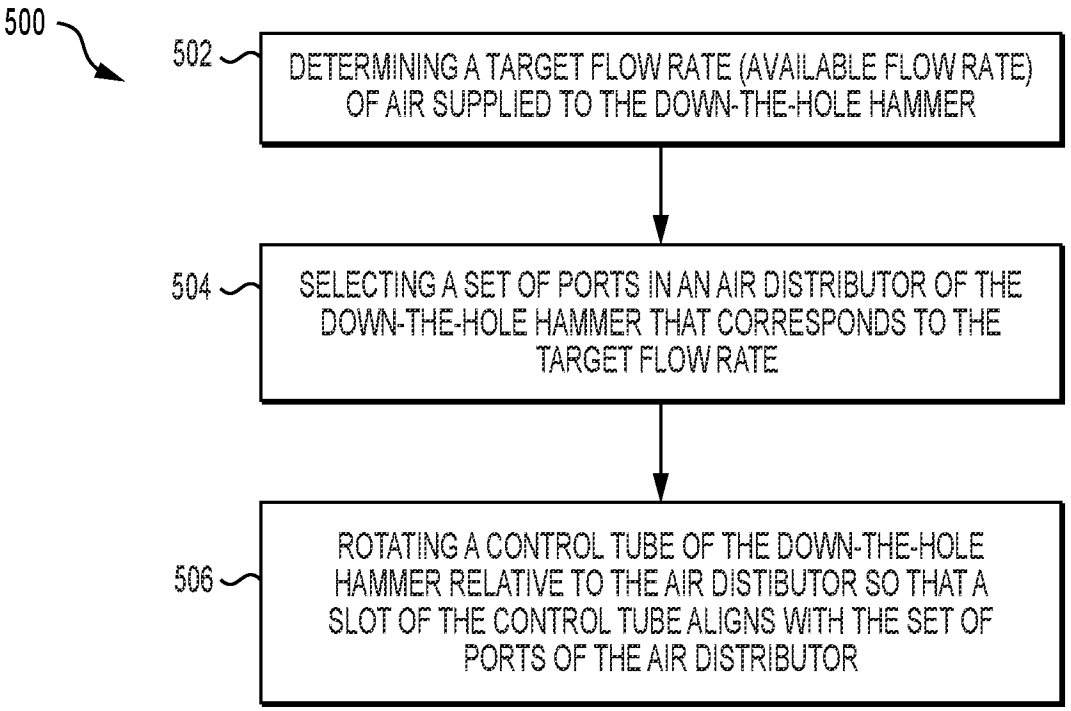
FIG. 23 provides a flowchart depicting an exemplary method for adjusting an air consumption valve of a down-the-hole hammer, according to aspects of the present disclosure.

FIG. 23 is a flow diagram illustrating an exemplary method 500 for adjusting air consumption valve of hammer 100. Method 500 may be performed as part of a setup operation prior to attaching hammer 100 to drill string in order to optimize hammer operation for a given air supply. Method 500 includes, at step 502, determining a target flow rate and target air pressure of air supplied to hammer 100. The target flow rate corresponds to the available flow rate of air supplied by the compressor to which hammer 100 and drill string are attached. The target air pressure may be slightly lower that the maximum operating pressure of the cylinder.

Method 500 further includes, at step 504, selecting a set of ports in air distributor 150 of the hammer 100 that corresponds to the target flow rate and air pressure. Each set of proximal ports 155, 155', 155" and distal ports 156, 156', 156" are optimal for a particular range of flow rates and air pressures. That is, set of first proximal port 155 and first distal port 156 is optimal for a first range of flow rates and air pressures, set of second proximal port 155' and second distal port 156' is optimal for a second range of flow rates and air pressure, and set of third proximal port 155" and third distal port 156" is optimal for a third range of flow rates and air pressure. If the target flow rate and air pressure determined at step 502 falls within the first range of flow rates and air pressures, set of first proximal port 155 and first distal port 156 is selected. If the target flow rate and air pressure determined at step 502 falls within the second range of flow rates and air pressures, set of second proximal port 155' and second distal port 156' is selected. If the target flow rate and air pressure determined at step 502 falls within the third range of flow rates and air pressures, set of third proximal port 155" and third distal port 156" is selected.

Method 500 further includes, at step 506, rotating control tube 140 of hammer 100 relative to air distributor 150 so that slot 144 of control tube 140 aligns with the set of ports of air distributor 150 selected at step 504. As described herein, rotating control tube 140 is achieved by rotating valve member 132 of check valve 130 via tool interface 136, which in turn rotates control tube 140 via the connection of grooves 147 and grooves 138. Control tube 140 is rotated in this manner until slot 144 of control tube 140 is aligned with the set of ports selected at step 504. Detent pin(s) 600 engage detent pocket(s) 148 of control tube 140 to rotationally lock control tube 140 relative to air distributor 500, ensuring the selected set of ports remain in alignment with slot 144 during operation of hammer 100. Once the selected set of ports is so aligned with slot 144, adapter 110 may be connected to the drill string and operation of hammer 100 may commence.

Rotation of control tube 140 is limited by the interaction of protrusion 143 of control tube 140 with arcuate channel 710 of air distributor 150 (see, e.g., FIGS. 9B and 9C). To change the set of ports in alignment with slot 144, an operator may first rotate control tube 140 (via check valve member 132) counterclockwise until protrusion 143 contacts sidewall 712. Contact between protrusion 143 and sidewall 712 provides tactile feedback to the operator that control tube 140 is in a default position. In some embodiments, this default position may correspond to the set of first proximal port 155 and first distal port 156 being aligned with slot 144. Clockwise rotation of control tube 140 such that detent pins 600 move to the adjacent detent pockets 148 provides tactile feedback that set of second proximal port 155' and second distal port 156' are aligned with slot 144. Further clockwise rotation of control tube 140 such that detent pins 600 move to the next adjacent detent pockets 148 provides tactile feedback that set of third proximal port 155" and third distal port 156" are aligned with slot 144.

The hammer 100 and method of the present disclosure allows for adjustment of control tube 140 to optimize the valve cycle of flow control valve 180 for different flow rates and pressures of air supplied to hammer 100. In particular, control tube 140 can be adjusted to control which of distal ports 156, 156', 156" of air distributor 150 is in fluid communication with slot 144 of control tube 140, thereby adjusting the time in the piston stroke at which distal port 156, 156', 156" enters piston 160, and consequently the time at which valve member 181 slides between the respective positions of FIGS. 21A and 21B. Thus, the operating cycle of hammer 100 can be tailored to the air supply, improving efficiency of hammer over a range of air flow rates and air pressures.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A down-the-hole hammer comprising:

a barrel having a longitudinal axis and defining a proximal chamber and a distal chamber;

a piston slidable within the barrel between the proximal chamber and the distal chamber;

a control tube having a slot;

a check valve member rotationally fixed to the control tube;

an air distributor having a plurality of sets of ports, each set of ports comprising a proximal port and a distal port longitudinally spaced apart from one another; and a flow control valve comprising a valve member slidable within the barrel along the longitudinal axis to control airflow through the piston, wherein the control tube is indexable between a plurality of rotational positions by rotating the check valve member to adjust which of the sets of ports of the air distributor is aligned with the slot of the control tube, wherein, in a first position of the valve member, the valve member allows air flow from a proximal end of the barrel through the piston and into the distal chamber, and wherein, in a second position of the valve member, the valve member allows air flow around the valve member and into the proximal chamber.

2. The down-the-hole hammer of claim 1, wherein a distance between the proximal port and the distal port of a first set of the plurality of sets of ports is different than a distance between the proximal port and the distal port of a second set of the plurality of sets of ports.

3. The down-the-hole hammer of claim 1, wherein the air distributor houses at least one detent pin, wherein the control tube defines at least one detent pocket, and wherein alignment of the at least one detent pin with the at least one detent pocket rotationally locks the control tube in one of the plurality of rotational positions.

4. The down-the-hole hammer of claim 3, wherein each of the at least one detent pockets comprises a ramped bottom surface configured to align the control tube in each of the plurality of rotational positions.

5. The down-the-hole hammer of claim 3, wherein rotation of the control tube relative to the air distributor causes each of the at least one detent pins to slide out of a respective one of the at least one detent pockets and into an adjacent one of the at least one detent pockets.

6. The down-the-hole hammer of claim 1, wherein the check valve member comprises a tool interface for receiving a tool for rotating the check valve member.

7. The down-the-hole hammer of claim 6, further comprising:

an adapter for receiving inlet air connected to a proximal end of the barrel, wherein the tool interface of the check valve member is accessible via the adapter.

8. The down-the-hole hammer of claim 1, wherein the flow control valve defines a valve chamber, and wherein the proximal port of each set of ports is aligned with the slot is in fluid communication with the valve chamber.

9. The down-the-hole hammer of claim 8, wherein sliding the valve member distally increases a volume of the valve chamber.

10. The down-the-hole hammer of claim 9, wherein a distance between the proximal port and the distal port of each set of ports of the air distributor governs when the valve member slides proximally.

11. The down-the-hole hammer of claim 1, wherein the check valve member comprises at least one spline, wherein the control tube comprises at least one groove engaging the at least one spline of the check valve member to rotationally lock the check valve member to the control tube, and wherein the at least one spline of the check valve member forms a slip fit with the at least one groove of the control tube to allow the check valve member to slide longitudinally with respect to the control tube.

12. A down-the-hole hammer comprising:

a control tube having a slot;

a check valve member rotationally fixed to the control tube; and an air distributor having a plurality of sets of ports, each set of ports comprising a proximal port and a distal port longitudinally spaced apart from one another, wherein the control tube is indexable between a plurality of rotational positions by rotating the check valve member to adjust which of the sets of ports of the air distributor is aligned with the slot of the control tube such that the proximal port and the distal port of one of the sets of ports are in fluid communication with the slot.

13. The down-the-hole hammer of claim 12, wherein a distance between the proximal port and the distal port of a first set of the plurality of sets of ports is different than a distance between the proximal port and the distal port of a second set of the plurality of sets of ports.

14. The down-the-hole hammer of claim 12, wherein the air distributor houses at least one detent pin, wherein the control tube defines at least one detent pocket, and wherein alignment of the at least one detent pin with the at least one detent pocket rotationally locks the control tube in one of the plurality of rotational positions.

15. The down-the-hole hammer of claim 12, wherein the check valve member comprises a tool interface for receiving a tool for rotating the check valve member.

16. A down-the-hole hammer comprising:

a control tube having a slot;

a check valve member rotationally fixed to the control tube; and an air distributor having a plurality of sets of ports, each set of ports comprising a proximal port and a distal port, wherein the control tube is movable between a plurality of positions to adjust which of the sets of ports of the air distributor is aligned with the slot of the control tube such that the slot extends between the proximal port and distal port.

17. The down-the-hole hammer of claim 16, wherein a distance between the proximal port and the distal port of a first set of the plurality of sets of ports is different than a distance between the proximal port and the distal port of a second set of the plurality of sets of ports.

18. The down-the-hole hammer of claim 16, wherein the air distributor houses at least one detent pin, wherein the control tube defines at least one detent pocket, and wherein alignment of the at least one detent pin with the at least one detent pocket rotationally locks the control tube in one of the plurality of positions.

19. The down-the-hole hammer of claim 18, wherein each of the at least one detent pockets comprises a ramped bottom surface configured to align the control tube in each of the plurality of rotational positions.

20. The down-the-hole hammer of claim 18, further comprising:

a barrel having a longitudinal axis and defining a proximal chamber and a distal chamber; and a piston slidable within the barrel between the proximal chamber and the distal chamber, wherein the air distributor houses at least one detent pin, wherein the control tube defines at least one detent pocket, and wherein alignment of the at least one detent pin with the at least one detent pocket rotationally locks the control tube in one of the plurality of rotational positions, and wherein rotation of the control tube relative to the air distributor causes each of the at least one detent pins to slide out of a respective one of the at least one detent pockets and into an adjacent one of the at least one detent pockets.

* * * * *